US009439483B1

(12) United States Patent
Weingarten

(10) Patent No.: US 9,439,483 B1
(45) Date of Patent: Sep. 13, 2016

(54) CUT DIAMOND PROVIDING PREDETERMINED OPTICAL PERFORMANCE

(71) Applicant: Jonathan Weingarten, Wantagh, NY (US)

(72) Inventor: Jonathan Weingarten, Wantagh, NY (US)

( * ) Notice: Subject to any disclaimer, the term of this patent is extended or adjusted under 35 U.S.C. 154(b) by 109 days.

(21) Appl. No.: 14/264,046

(22) Filed: Apr. 28, 2014

Related U.S. Application Data

(63) Continuation-in-part of application No. 12/797,001, filed on Jun. 9, 2010, now Pat. No. 8,707,733.

(51) Int. Cl.
*A44C 17/00* (2006.01)

(52) U.S. Cl.
CPC ..... *A44C 17/00* (2013.01)

(58) Field of Classification Search
CPC ..... A44C 17/00
USPC ..... 63/32; D11/90
See application file for complete search history.

(56) References Cited

PUBLICATIONS

"New Old Miners" article, JCK Magazine, Jun. 2001, p. 18.
Levine, Gail, "Big Fat Caveat" article, Jewellery Business Magazine, Dec. 2008, pp. 24-26.
Tillander, Herbert, Diamond Cuts in Historic Jewellery 1381-1910, London, 1995, pp. 169-171.
Unruh, Carl, The Faceter's Gem Cuts, vol. 2, Carlsbad, California, 1977, p. 71.
Diamond Grading Report excerpt, Gemological Institute of America, Carlsbad, California, Apr. 24, 2006.
Diamond Grading Report excerpt, Gemological Institute of America, Carlsbad, California, Jul. 27, 2009.
Diamond Grading Report excerpt, Gemological Institute of America, Carlsbad, California, Aug. 3, 2009.
Diamond Grading Report excerpt, Gemological Institute of America, Carlsbad, California, Nov. 28, 2006.
Diamond Grading Report excerpt, Gemological Institute of America, Carlsbad, California, Jan. 3, 2008.
Diamond Grading Report excerpt, Gemological Institute of America, Carlsbad, California, Feb. 18, 2009.
Diamond Grading Report excerpt, Gemological Institute of America, Carlsbad, California, Apr. 28, 2008.
Diamond Grading Report excerpt, Gemological Institute of America, Carlsbad, California, Feb. 5, 2009.
Diamond Grading Report excerpt, Gemological Institute of America, Carlsbad, California, Sep. 24, 2009.
Diamond Grading Report excerpt, Gemological Institute of America, Carlsbad, California, Jul. 6, 2009.
Diamond Grading Report excerpt, Gemological Institute of America, Carlsbad, California, Aug. 20, 2009.
Diamond Grading Report excerpt, Gemological Institute of America, Carlsbad, California, Aug. 25, 2009.
Diamond Grading Report excerpt, Gemological Institute of America, Carlsbad, California, Jun. 15, 2009.
Diamond Grading Report excerpt, Gemological Institute of America, Carlsbad, California, Apr. 27, 2009.
The Jewelers' Circular-Weekly, Jan. 29, 1919 issue, p. 51.

*Primary Examiner* — Jack W Lavinder
(74) *Attorney, Agent, or Firm* — Yuri Astvatsaturov

(57) ABSTRACT

A gemstone cut with a table facet, where the gemstone receives existing light from around the viewer and the facets on the bottom of the diamond effectively reflect the existing light back into the eyes of the beholder in such a manner as to maximize light performance and to provide specific optical performance.

34 Claims, 21 Drawing Sheets

Top View

Bottom View

Top View

Bottom View

Top View

Bottom View

CUT DIAMOND PROVIDING PREDETERMINED OPTICAL PERFORMANCE

CROSS-REFERENCE TO RELATED APPLICATIONS

This application is a continuation-in-part of U.S. patent application Ser. No. 12/797,001, entitled "A CUT GEMSTONE PROVIDING A SPECIFIC OPTICAL PATTERN," filed on Jun. 9, 2010, and incorporated herein by reference in its entirety.

FIELD OF THE INVENTION

The invention relates to gemstones, preferably diamonds, that have a cut or shape that causes light entering the gemstone to exit in a specific optical pattern. In particular the present invention relates to diamonds where the light exiting through the table facet provides a pattern in the shape of a Maltese cross.

BACKGROUND

One of the values of gemstones, is in their appearance. The appearance of the gemstone can often be enhanced by cutting the gemstone into different shapes, and polishing the surface of the gemstone. This is especially true with gemstones that at least pass some light through them, especially diamonds. Depending on the angle that the light strikes the surface and the material of the gemstone, the light can neither be reflected from the surface or pass through the surface. If the light passes into the gemstone, it passes through the gemstone until it reaches another surface. At this other surface, the light in the gemstone can either be reflected back into the gemstone or pass out of the gemstone.

It is often desirable to shape the gemstone so that the light entering one area of the gemstone is redirected by the gemstone to exit from another area. In particular it is often desirable to maximize the light exiting one area, since this gives the gemstone a brilliance or sparkle. Many different gemstone cuts are known, particularly for diamonds, to try to maximize the amount of light that exits one particular area of the gemstone.

One of the most popular cuts for a diamond is known as the "brilliant," which arranges the individual flat surfaces or facets to maximize the light passing out through the main table facet. The "brilliant" cut has a crown portion, a girdle portion and a pavilion portion. Each of these portions has a plurality of facets, especially the crown portion and pavilion portion. The arrangement of these facets is well known to a person of ordinary skill in the art of the present invention, and therefore no further description of the arrangement of facets in the "brilliant" cut is necessary or warranted.

There are many variations of the "brilliant" cut style. Very often the angle of the facets is changed slightly to account for the original shape of the rough diamond, to increase the yield from the rough diamond, or personal preferences. Sometimes the shapes of the facets are changed to provide a finish diamond with a square or rectangular shape. Even with these variations, the cuts still follow the well-known "brilliant" style.

There are many other antique facet designs, such as the "Old Mine Cut." The arrangement of the facets in these antique designs are well known to a person of ordinary skill in the art of the present invention, and therefore no further description of the arrangement of facets in these antique facet designs is necessary or warranted.

SUMMARY OF THE INVENTION

It is an object of the present invention to provide a gemstone cut with a table facet, where the gemstone receives existing light from around the viewer and for the facets on the bottom of the diamond to effectively reflect the existing light back into the eyes of the beholder in such a manner as to maximize light performance, and to produce a unique and distinct look of light in the form of a Maltese cross under the table facet which can be observed in natural ambient light.

The present invention accomplishes this object in a polygonal gemstone with a girdle portion having corners and a girdle plane. A crown portion extends from one side of the girdle portion, and includes a table facet with a plurality of crown facets arranged around the table facet. A pavilion portion extends from another side of the girdle portion diametrically opposite the crown portion, and includes a plurality of pavilion facets tapering the pavilion portion together as the pavilion portion extends away from the girdle. The facets are in an arrangement or a facet structure that follows that of the antique facet design, the "Old Mine Cut" or the brilliant facet style, and where the angles of the facets have been proportioned in such a manner as to provide the above described Maltese cross effect under the table facet.

In another embodiment, the present invention is a cut diamond having a plurality of facets where the cut diamond includes a girdle portion having four sides and four corners, the girdle portion having a girdle plane. The cut diamond further includes a crown portion adjacent to the girdle portion, where the crown portion includes: a table facet having eight sides and eight vertices; four crown main facets, each of the four crown main facets positioned between the table facet and one of the four sides of the girdle portion, and extends between about one of the eight vertices of the table facet and about a midpoint of respective the one side; four crown corner facets, each of the four crown corner facets positioned between the table facet and one of the four corners of the girdle portion, and extends between about one of the eight vertices of the table facet and about a midpoint of respective the one corner, each of the four crown corner facets further positioned between two of the four crown main facets; eight crown star facets, each of the eight crown star facets positioned between the table facet, one of the four crown main facets, and one of the four crown corner facets; and sixteen crown half facets, each of the sixteen crown half facets positioned between the girdle portion, one other the crown half facet, and one of one of the four crown main facets and one of the four crown corner facets. The cut diamond further includes a pavilion portion adjacent to the girdle portion and positioned diametrically opposite the crown portion, the pavilion portion tapering inward towards a point of convergence as it extends away from the girdle portion, where the pavilion portion includes four pavilion main facets, each of the four pavilion main facets positioned partially below one of the four crown main facets when the cut diamond is viewed from above, each of the four pavilion main facets further positioned between one of the four sides of the girdle portion and the point of convergence, and extends between about the midpoint of respective the one side and about the point of convergence; four pavilion corner facets, each of the four pavilion corner facets positioned partially below one of the four crown corner facets when the cut diamond is viewed from above, each of the four pavilion corner facets further positioned between one of the four corners of the girdle portion and the point of convergence, and extends between about the midpoint of respective the one corner and about the point of convergence; and sixteen pavilion half facets, each of the sixteen pavilion half facets positioned between the girdle portion, one other the pavilion half facet, and one of one of the four pavilion main facets and one of the four pavilion corner facets, each of the sixteen pavilion half facets including a respective side extending from a respective girdle/pavilion point on the girdle portion towards the point of convergence with a respective pavilion half facet length that is less than or equal to about 85% of a respective total pavilion length from the respective girdle/pavilion point to the point of convergence, each of the respective pavilion half facet lengths and each of the respective total pavilion lengths measured along the girdle plane. When the cut diamond is viewed from above, a majority of the cut diamond reflects incident light impinging on the cut diamond at an angle between 45 and 75 degrees with respect to the girdle plane.

In another embodiment, the present invention is a cut diamond having a plurality of facets, where the cut diamond comprises a girdle portion having four sides and four corners, the girdle portion having a girdle plane. The cut diamond further includes a crown portion adjacent to the girdle portion, where the crown portion includes a table facet having eight sides and eight vertices; four crown main facets, each of the four crown main facets positioned between the table facet and one of the four sides of the girdle portion, and extends between about one of the eight vertices of the table facet and about a midpoint of respective the one side; four crown corner facets, each of the four crown corner facets positioned between the table facet and one of the four corners of the girdle portion, and extends between about one of the eight vertices of the table facet and about a midpoint of respective the one corner, each of the four crown corner facets further positioned between two of the four crown main facets; eight crown star facets, each of the eight crown star facets positioned between the table facet, one of the four crown main facets, and one of the four crown corner facets; and sixteen crown half facets, each of the sixteen crown half facets positioned between the girdle portion, one other the crown half facet, and one of one of the four crown main facets and one of the four crown corner facets. The cut diamond further includes a pavilion portion adjacent to the girdle portion and positioned diametrically opposite the crown portion, the pavilion portion tapering inward towards a point of convergence as it extends away from the girdle portion, where the pavilion portion includes four pavilion main facets, each of the four pavilion main facets positioned partially below one of the four crown main facets when the cut diamond is viewed from above, each of the four pavilion main facets further positioned between one of the four sides of the girdle portion and the point of convergence, and extends between about the midpoint of respective the one side and about the point of convergence; four pavilion corner facets, each of the four pavilion corner facets positioned partially below one of the four crown corner facets when the cut diamond is viewed from above, each of the four pavilion corner facets further positioned between one of the four corners of the girdle portion and the point of convergence, and extends between about the midpoint of respective the one corner and about the point of convergence; and sixteen pavilion half facets, each of the sixteen pavilion half facets positioned between the girdle portion, one other the pavilion half facet, and one of one of the four pavilion main facets and one of the four pavilion corner facets. The four pavilion main facets produce an optical pattern of a first cross under the table facet when the cut diamond is viewed from above, the first cross including four arms extending from the point of convergence towards the sides of girdle portion, each of the four arms including two arm sides extending from the point of convergence to one of the eight sides of the table facet, each of the arm sides including a first subsection and a second subsection, the first and the second subsections being joined at a joinder point and forming a non-180 degree angle there between. Also, when the cut diamond is viewed from above, a majority of the cut diamond reflects incident light impinging on the cut diamond at an angle between 45 and 75 degrees with respect to the girdle plane.

In another embodiment, the present invention is a cut diamond having a plurality of facets, the cut diamond comprises a girdle portion having four sides and four corners, the girdle portion having a girdle plane. The cut diamond further comprises a crown portion adjacent to the girdle portion, where the crown portion includes a table facet having eight sides and eight vertices; four crown main facets, each of the four crown main facets positioned between the table facet and one of the four sides of the girdle portion, and extends between about one of the eight vertices of the table facet and about a midpoint of respective the one side; four crown corner facets, each of the four crown corner facets positioned between the table facet and one of the four corners of the girdle portion, and extends between about one of the eight vertices of the table facet and about a midpoint of respective the one corner, each of the four crown corner facets further positioned between two of the four crown main facets; eight crown star facets, each of the eight crown star facets positioned between the table facet, one of the four crown main facets, and one of the four crown corner facets; and sixteen crown half facets, each of the sixteen crown half facets positioned between the girdle portion, one other the crown half facet, and one of one of the four crown main facets and one of the four crown corner facets. The cut diamond further comprises a pavilion portion adjacent to the girdle portion and positioned diametrically opposite the crown portion, the pavilion portion tapering inward towards a point of convergence as it extends away from the girdle portion, where the pavilion portion includes four pavilion main facets, each of the four pavilion main facets positioned partially below one of the four crown main facets when the cut diamond is viewed from above, each of the four pavilion main facets further positioned between one of the four sides of the girdle portion and the point of convergence, and extends between about the midpoint of respective the one side and about the point of convergence; four pavilion corner facets, each of the four pavilion corner facets positioned partially below one of the four crown corner facets when the cut diamond is viewed from above, each of the four pavilion corner facets further positioned between one of the four corners of the girdle portion and the point of convergence, and extends between about the midpoint of respective the one corner and about the point of convergence; and sixteen pavilion half facets, each of the sixteen pavilion half facets positioned between the girdle portion, one other the pavilion half facet, and one of one of the four pavilion main facets and one of the four pavilion corner facets. The four pavilion main facets produce an optical pattern of a first cross under the table facet when the cut diamond is viewed from above, the first cross including four arms extending from the point of convergence towards the sides of girdle portion, each of the four arms including two arm sides extending from the point of convergence to one of the eight sides of the table facet, each of the arm sides including a first subsection and a second subsection, the first and the second subsections being joined at a joinder point and forming a non-180 degree angle there between. Also, a majority of portions of the pavilion main facets which produce the optical pattern of the cross reflect incident light impinging on the cut diamond at an angle between 45 and 75 degrees with respect to the girdle plane, when the cut diamond is viewed from above.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 1:
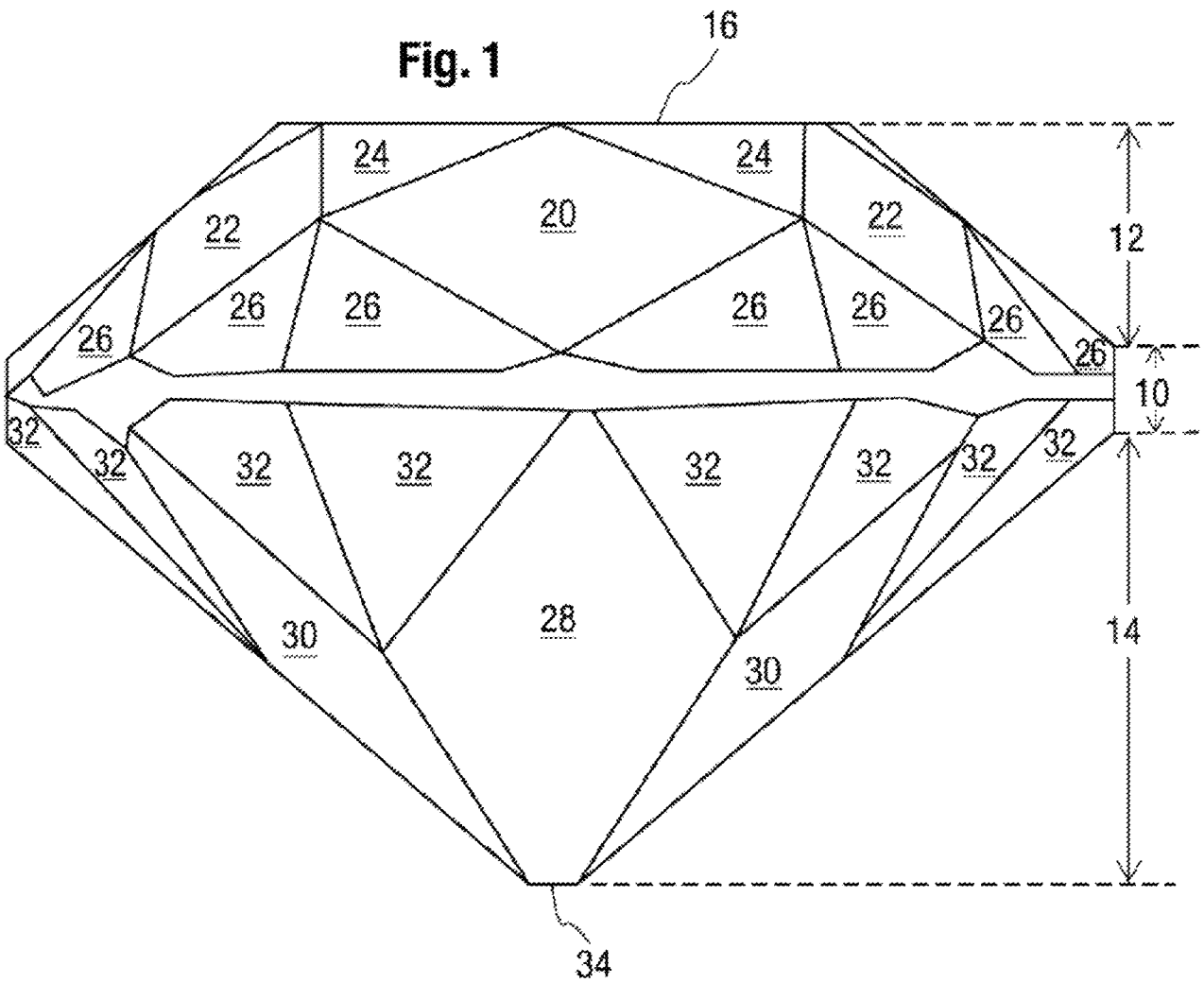
FIG. 1 is a side view of an embodiment of the gemstone cut.
Figure 2:
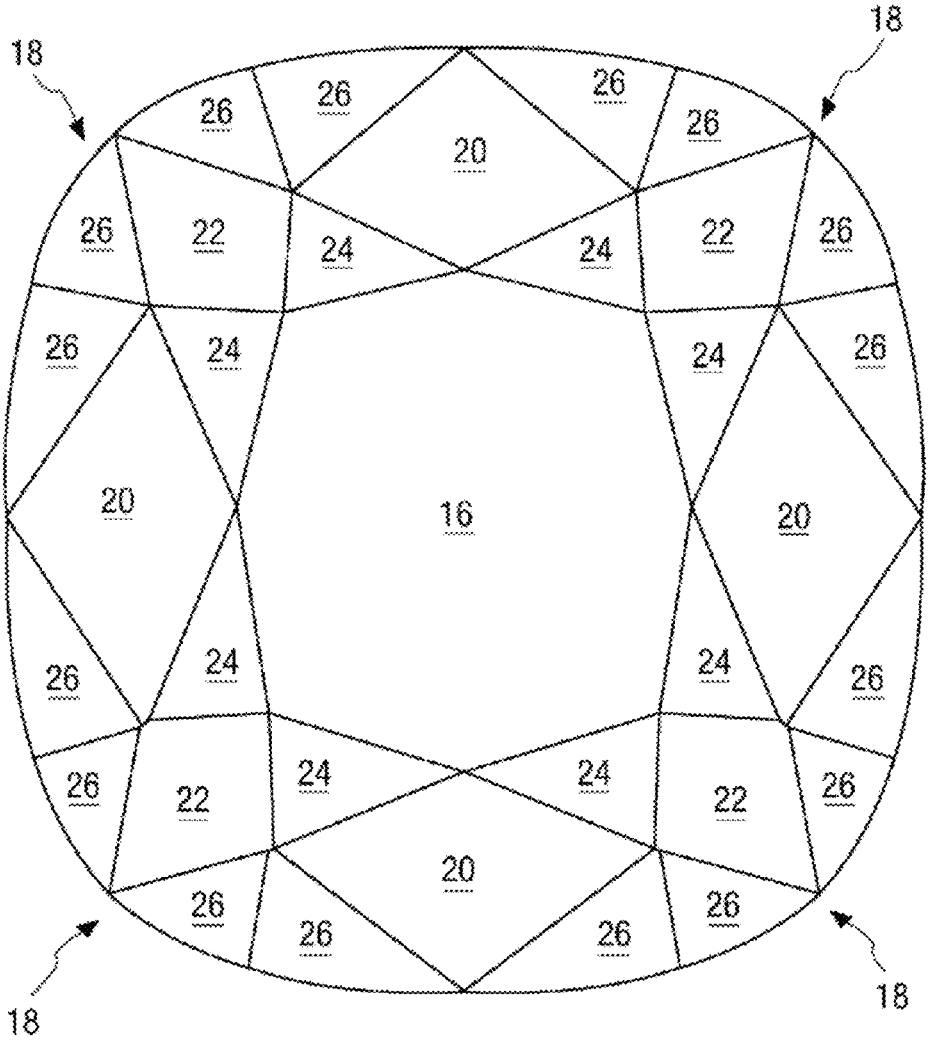
FIG. 2 is a top view of the gemstone cut.
Figure 3:
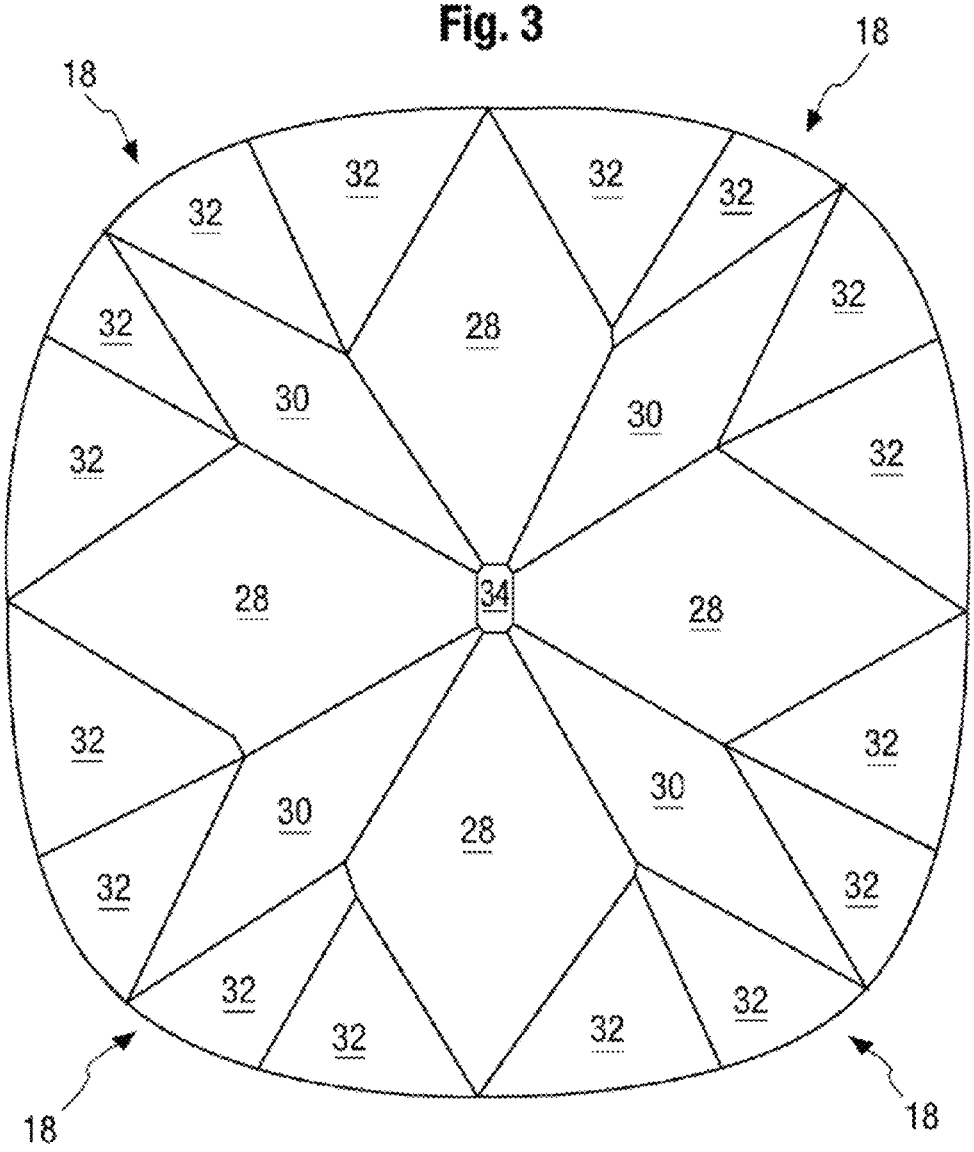
FIG. 3 is a bottom view of the gemstone cut.

Referring to the drawings in particular, FIG. 1 shows a side view of a gemstone, not necessarily drawn to scale. The gemstone has a girdle portion 10 in a square or rectangular shape and having rounded corners 18, FIG. 2. The length to width ratios for rectangular stones are preferably less than 1.10:1. A crown portion 12 extends from one side of the girdle portion 10, and a pavilion portion 14 extends from another side of the girdle portion 10. The crown portion 12 and pavilion portion 14 are on diametrically opposite sides of the girdle portion 10. The crown portion 12 and the pavilion portion 14 have a plurality of facets. The girdle portion 10 can optionally be smooth or faceted.

The crown facets include, a table facet 16, four crown main facets 20, and four crown corner facets 22. Each of the four crown corner facets 22 is arranged in the area of one of the four rounded corners 18 of the girdle portion 10. The crown main facets 20 and crown corner facets 22 are alternately arranged around the table facet 16 with each of the crown main facets 20 being arranged between two of the crown corner facets 22.

The crown facets also include eight crown star facets 24 arranged between the table facet 16, the crown main facets 20, and the crown corner facets 22. One of these crown star facets 24 is arranged between, and is adjacent, each adjacent pair of corner crown facets 22 and corner main facets 20. Each crown star facet 24 is also adjacent to one edge of the table facet 16.

The crown facets also include sixteen crown half facets or crown girdle facets 26 arranged around the table facet 16 and directly adjacent to the girdle portion 10. Two of these crown half facets 26 are arranged between each adjacent pair of crown corner facets 22 and crown main facets 20. Each of these crown half facets 26 is also directly adjacent to either a crown main facet 20 or a crown corner facet 22.

The pavilion facets include four pavilion main facets 28 and four pavilion corner facets 30. Each of the four pavilion corner facets 30 is arranged in the area of one of the four rounded corners 18 of the girdle portion 10. The pavilion main facets 28 and pavilion corner facets 30 are alternately arranged around the pavilion portion 14 with each of the pavilion main facets 28 being arranged between two of the pavilion corner facets 30.

The pavilion facets also include sixteen pavilion half facets or pavilion girdle facets 32 arranged around the pavilion portion 14 and directly adjacent to the girdle portion 10. Two of these pavilion half facets 32 are arranged between each adjacent pair of pavilion main facets 28 and pavilion corner facets 30. Each of these pavilion half facets 32 is also directly adjacent to either a pavilion main facet 28 or a pavilion corner facet 30. The pavilion portion 14 can also have a culet 34.

Figure 4:
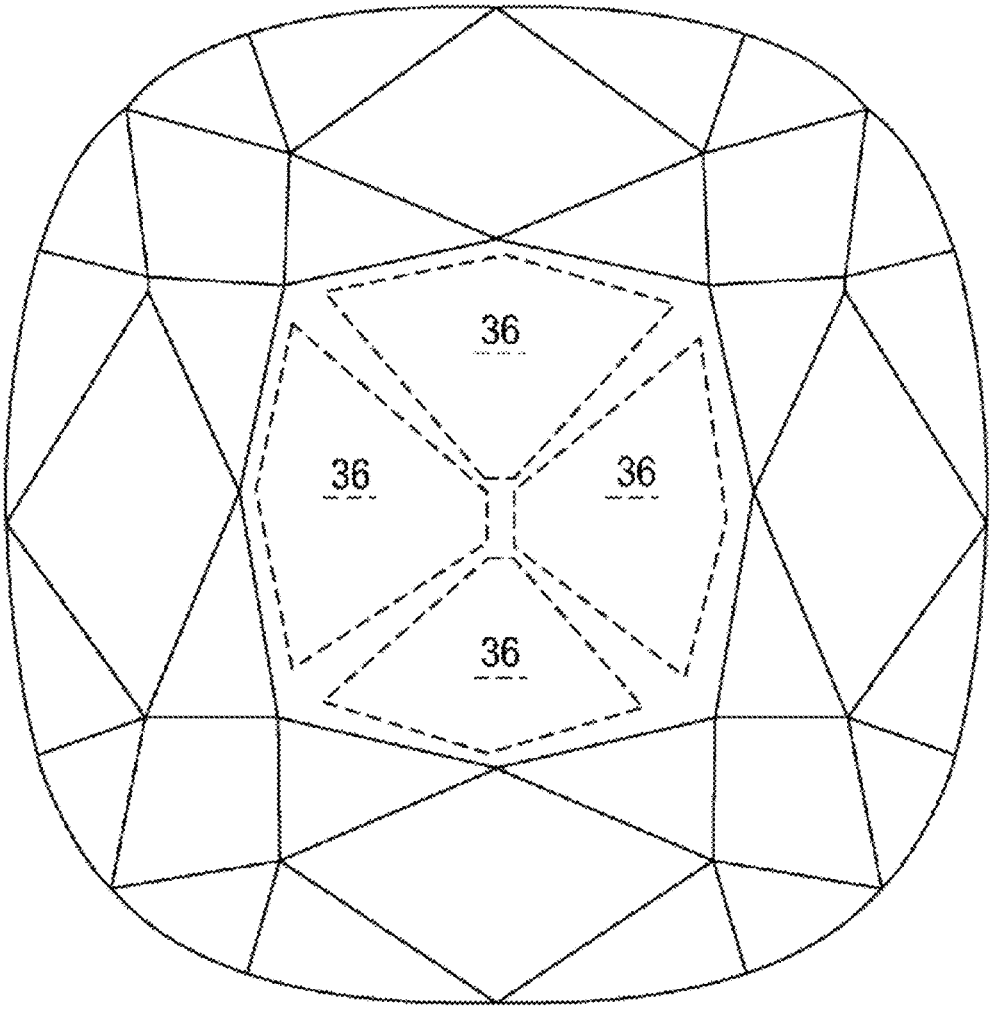
FIG. 4 is a top view of the gemstone cut showing the Maltese cross pattern in a schematic view.
Figure 5:
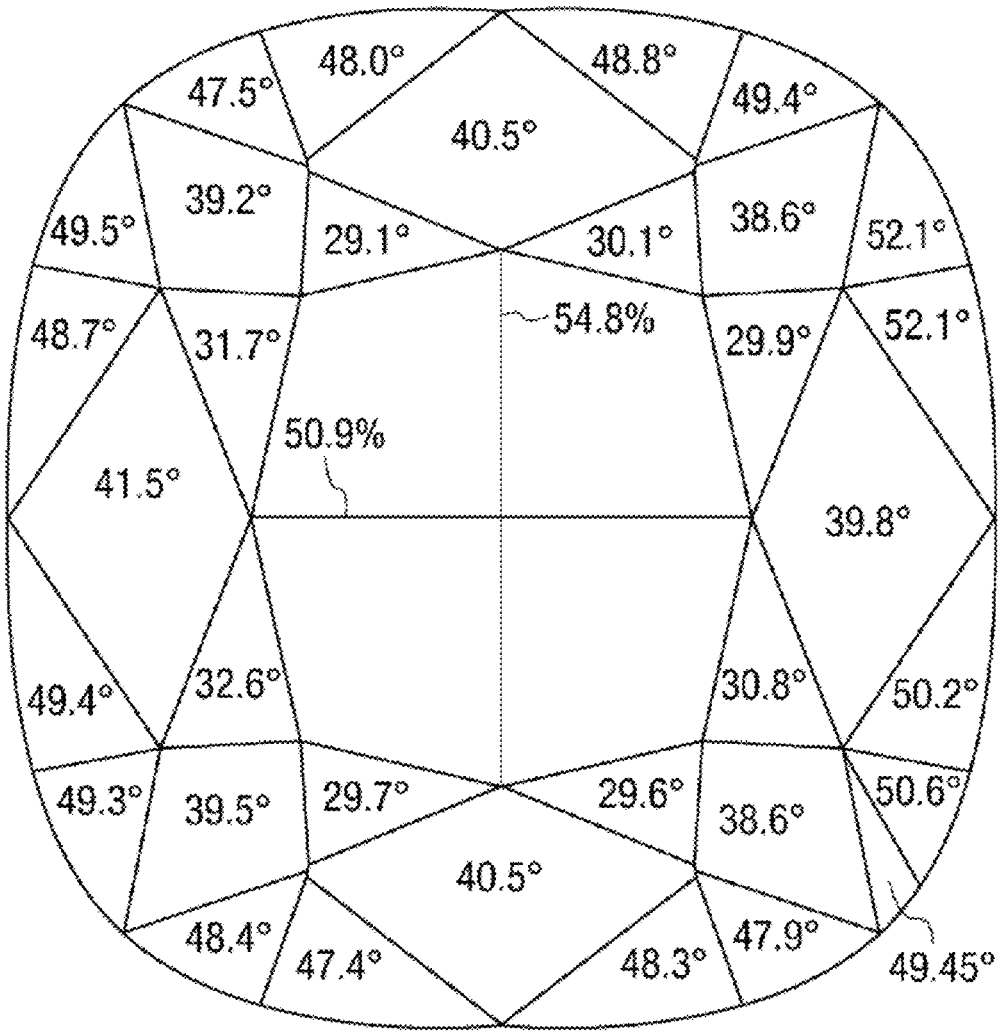
FIGS. 5 and 6 are top and bottom views respectively of one embodiment of the present invention.
Figure 6:
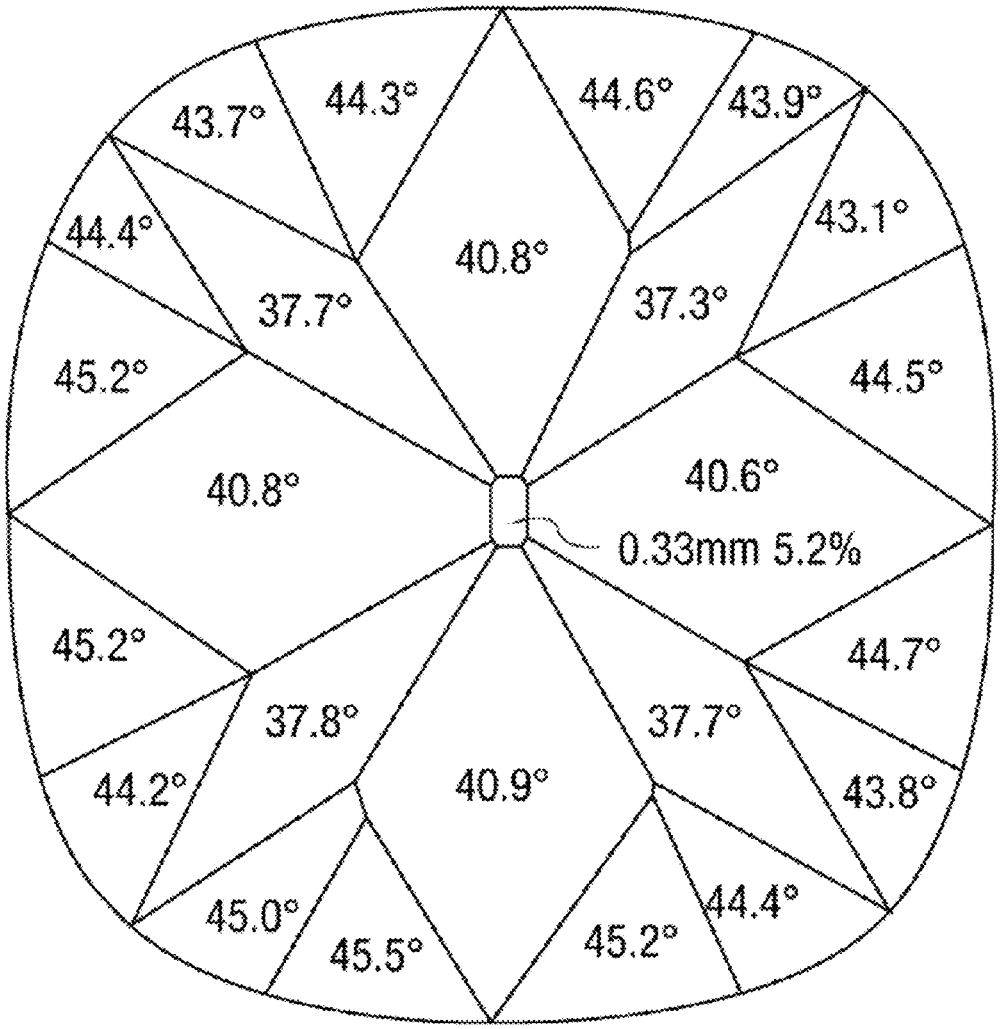
Figure 7:
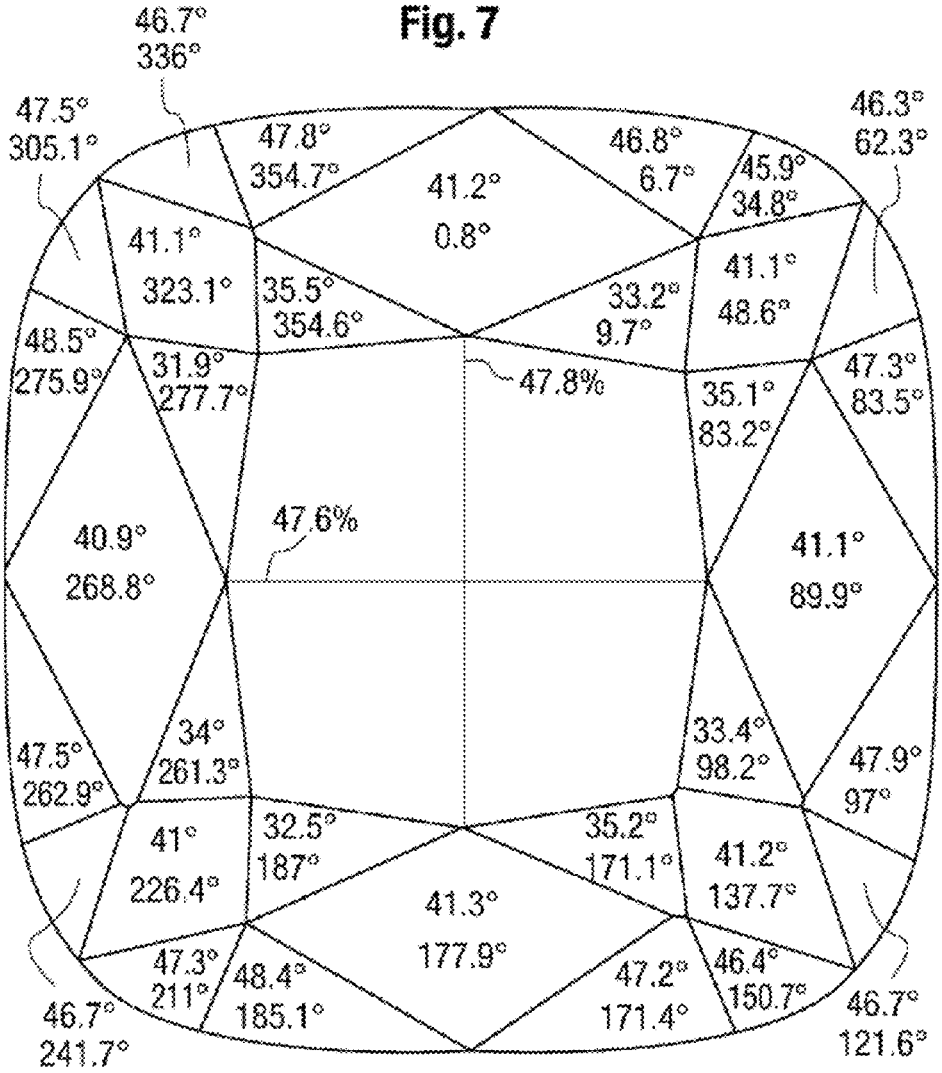
FIGS. 7 and 8 are top and bottom views respectively of another embodiment of the present invention.
Figure 8:
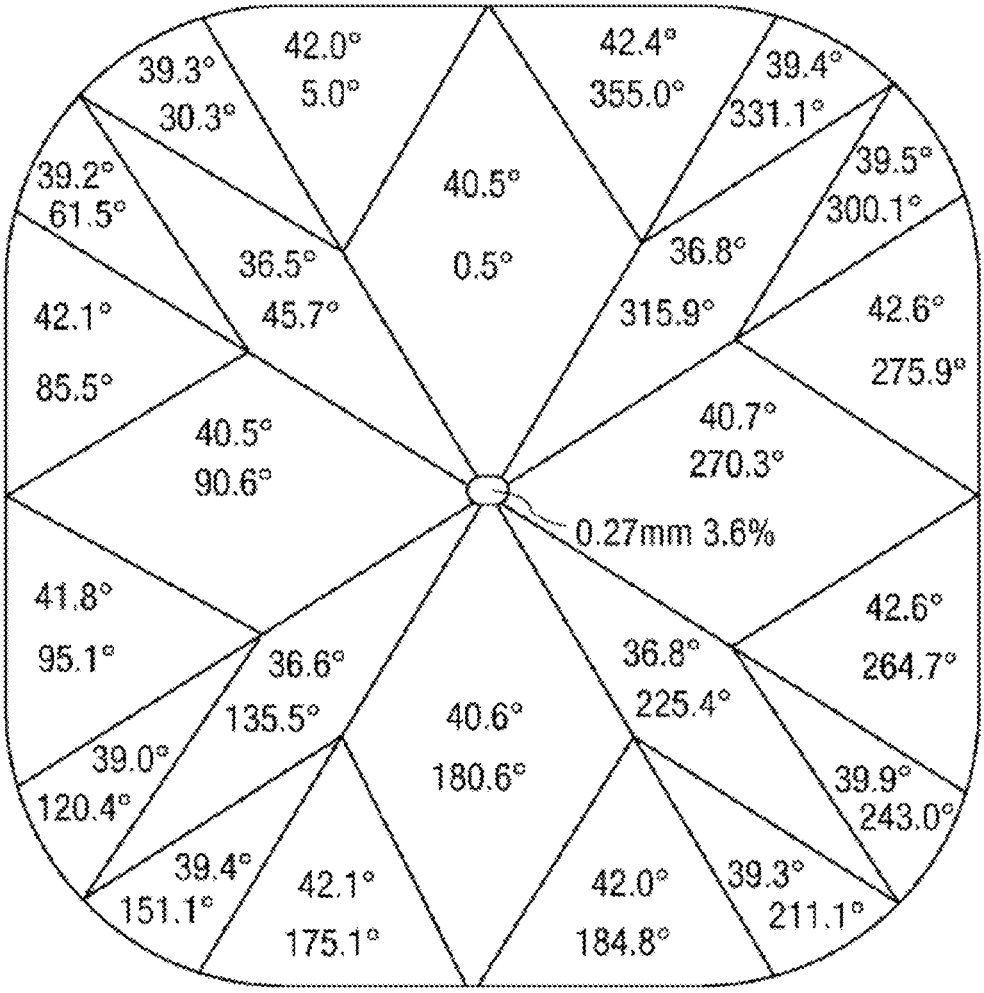
Figure 9:
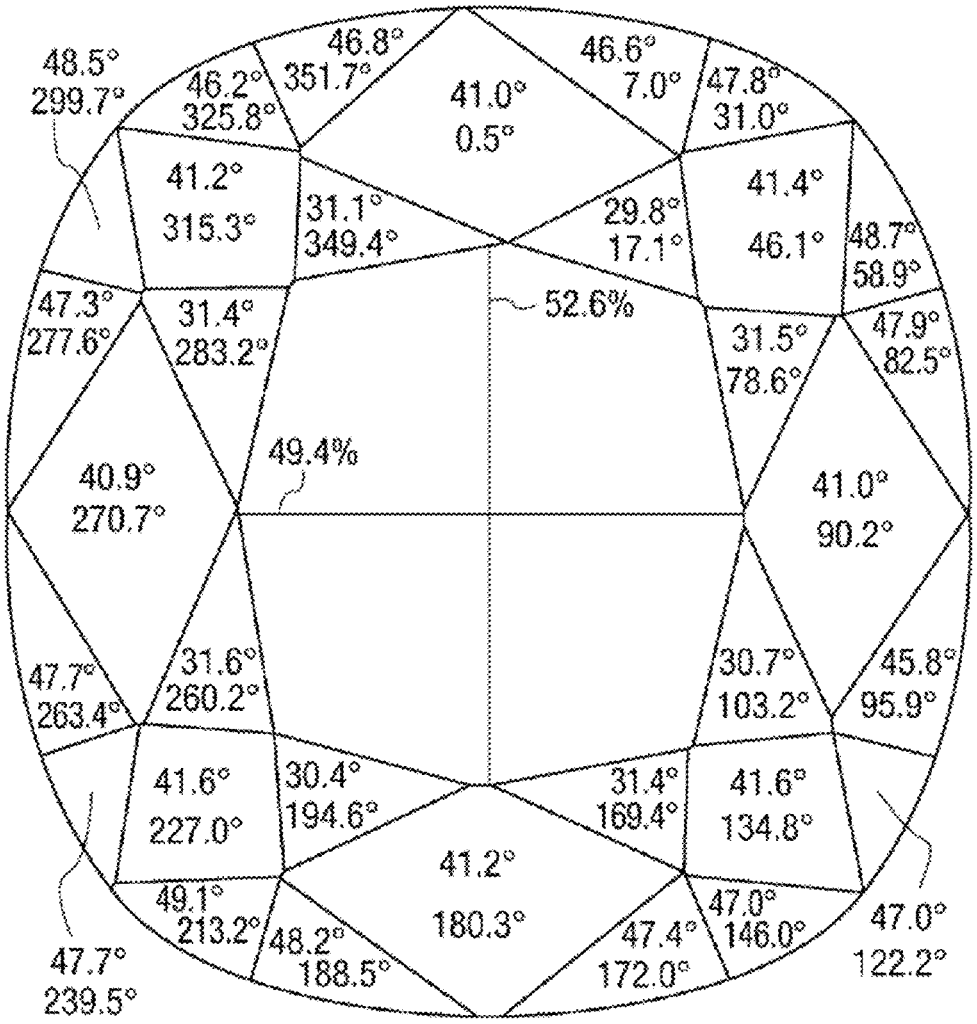
FIGS. 9 and 10 are top and bottom views respectively of still another embodiment of the present invention.
Figure 10:
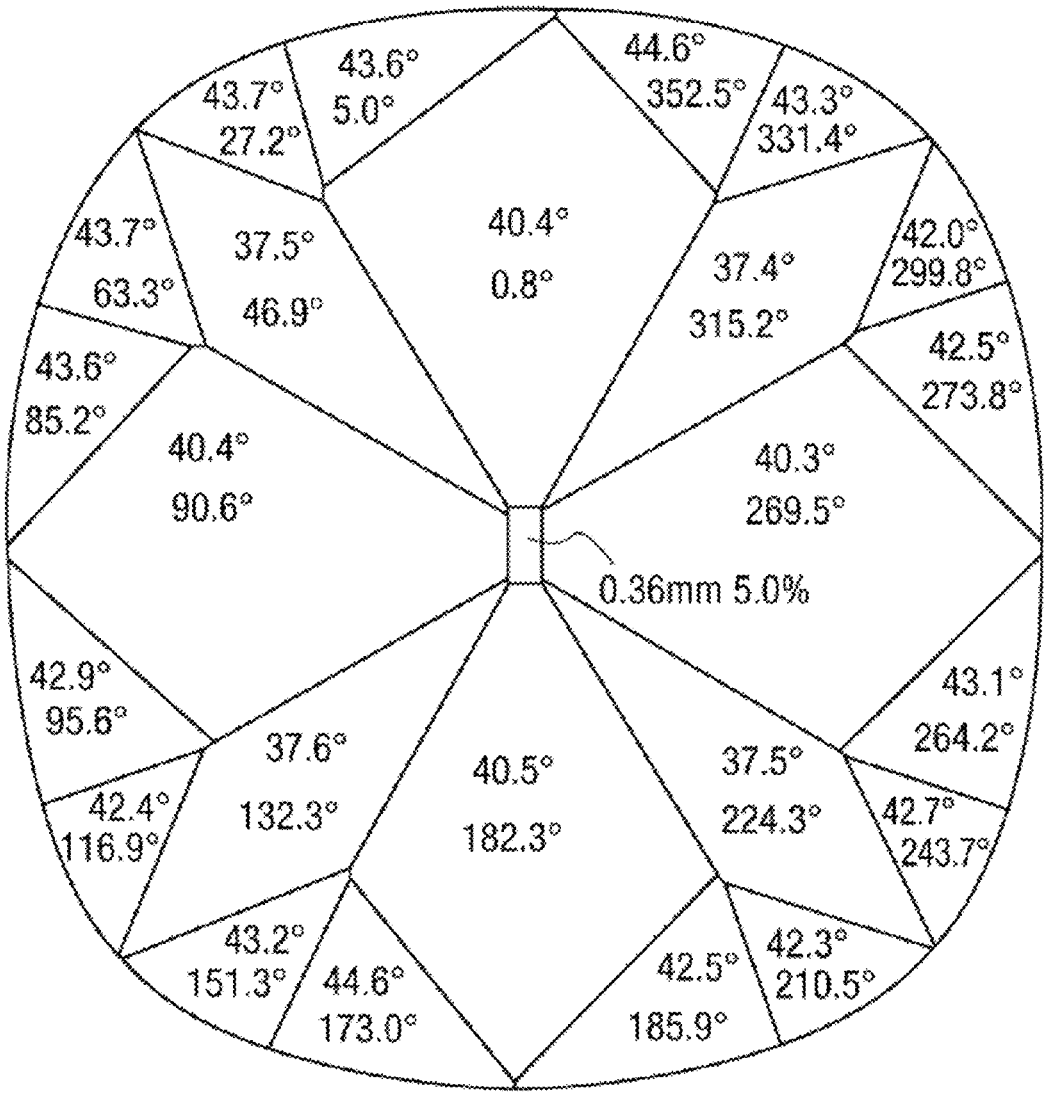

In order to produce the optical pattern of a Maltese cross 36, as shown in FIG. 4, under the table facet 16, the crown and pavilion facets are arranged in specific angular ranges with respect to a plane of the girdle portion 10. These angles depend on the refractive index of the gemstone. For a diamond gemstone, the facets would be preferably arranged in the following ranges:

- crown main facets 20: 38-42.5 degrees (FIG. 5 for example of upper limit +1 degree);
- crown corner facets 22: 37-42.6 degrees (FIG. 9 for example of upper limit +1 degree);
- crown star facets 24: 28-36.5 degrees (FIG. 7 for example of upper limit +1 degree);
- crown half facets 26: 44.8-53.1 degrees (FIG. 9 for example of lower limit −1 degree, FIG. 5 for example of upper limit +1 degree);
- pavilion main facets 28: 39.3-41.9 degrees (FIG. 10 for example of lower limit −1 degree, FIG. 6 for example of upper limit +1 degree), (preferably 40.4-40.9 degrees);
- pavilion corner facets 30: 35.5-40 degrees (FIG. 8 for example of lower limit −1 degree); and
- pavilion half facets 32: 38-46.5 degrees (FIG. 8 for example of lower limit −1 degree, FIG. 6 for example of upper limit +1 degree).

To further produce the optical pattern of a Maltese cross, it is preferable for the table facet to be 48-52% of the width of the diamond, the lower half facet length to be 50% (+/−5%) with respect to length from the edge of the girdle to the cullet, and the star facet/upper half facet ratio to be 45%-55% (+/−5%) with respect to table edge-to-girdle length.

The pavilion facets on the bottom of a diamond will function as either mirrors (reflectors of light, good) or windows (leakers of light, bad). An important step in the optical design is ensuring that the pavilion (bottom facets) are effectively reflecting light back to the viewer. Another important step in the optical design is ensuring that the crown of the diamond draws in its reflections from the brightest resources in the environment. The present invention is designed for the majority of its reflections from the 45-75° angular spectrum.

Several of the preferred embodiments of the gemstone in diamond are shown in FIGS. 5 & 6, 7 & 8, and 9 & 10. In FIGS. 5 and 6, the slope angles are shown for each facet. In FIGS. 7 through 10, the top angular measurement shown in each facet is the slope angle, and the bottom angular measurement is the index angle. The index angle shows the position of the facet around the stone. These actual angles can vary by approximately plus or minus one degree in these embodiments. The dimensions of the table facet and the culet are also shown. All of the facets in each type of facet can either have the same slope angle, or a slightly different slope angle as shown in the drawings.

Figure 11:
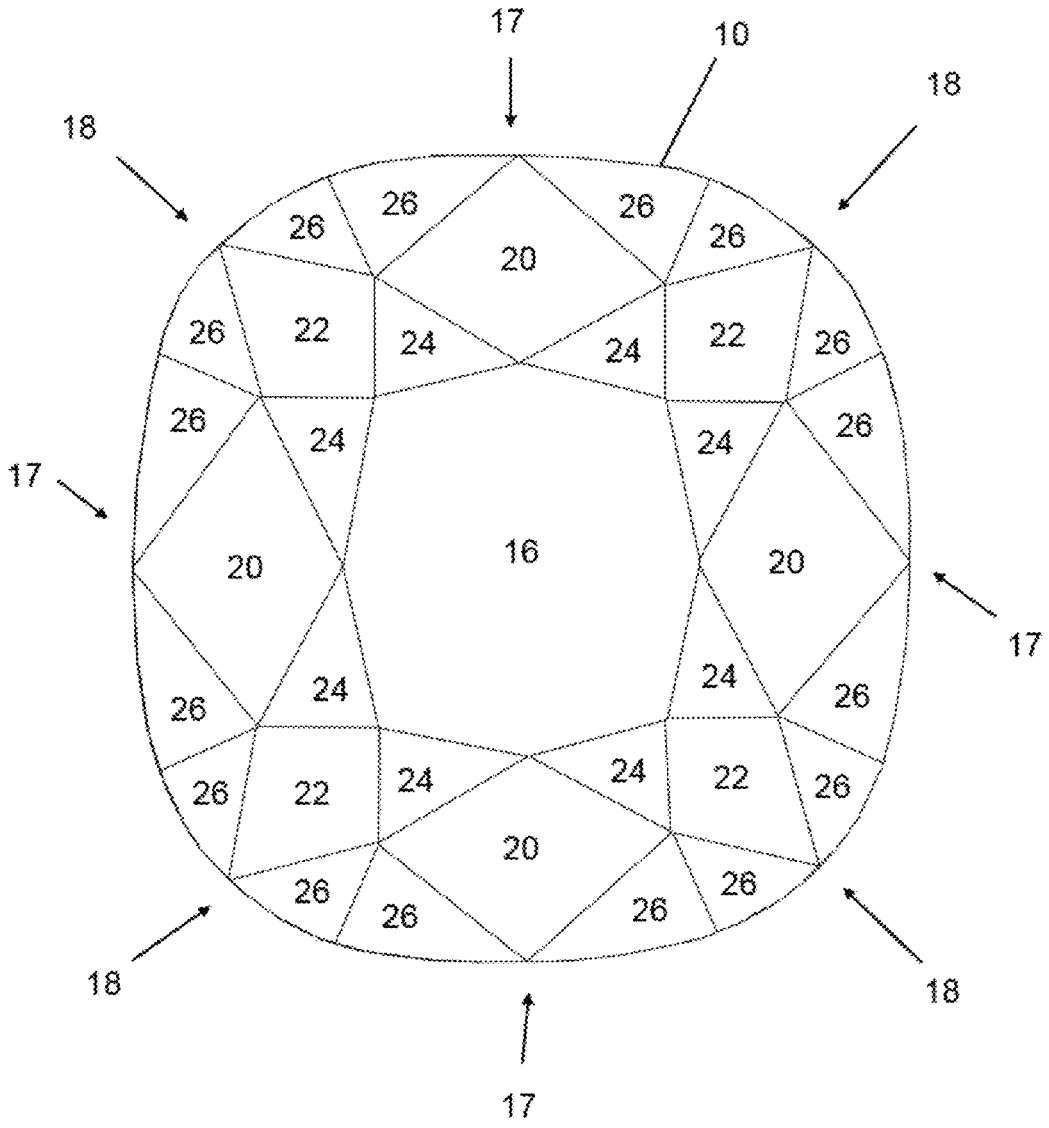
FIGS. 11 and 12 are top and bottom views respectively of still another embodiment of the present invention.

Another embodiment of a gemstone cut in accordance with the present invention is shown in FIGS. 11-13C. FIG. 11 illustrates a top view of said gemstone which shows the overall shape of the girdle portion 10 having four sides 17 and four corners 18, and a series of facets positioned on the gemstone's crown portion. In particular, the crown portion includes an eight-sided table facet 16 which includes eight vertices. The table facet 16 is positioned such that a line drawn through midpoints of two directly opposing sides 17 will pass over or near two directly opposing vertices of the table facet. Note that due to the inherent difficulties of attaining perfect or near-perfect symmetry during gemstone cutting, the reference of the line passing near two directly opposing vertices of the table facet serves to differentiate the positioning of the table facet 16 as shown in FIG. 11 (also shown in FIGS. 1, 4, 5, 7, 9, 14, and 17) from an embodiment where a line drawn through midpoints of two directly opposing sides 17 will pass over or near the midpoints of two directly opposing sides of the table facet.

The crown portion further includes four crown main facets 20 and four crown corner facets 22. Each of the four crown main facets 20 is positioned between the table facet 16 and one of the sides 17 such that it substantially extends between about one of the vertices of the table facet 16 and about the midpoint of the respective side 17. Each of the four crown corner facets is positioned between the table facet 16 and one of the corners 18 such that it substantially extends between about one of the vertices of the table facet 16 and about the midpoint of the respective corner 18. Both the crown main facets 20 and crown corner facets 22 are illustrated as having a substantially kite shape. The crown main 20 and corner 22 facets are arranged in an alternating fashion such that no two crown main facets 20 are immediately adjacent to one another and no two crown corner facets 22 are immediately adjacent to one another.

The crown further includes eight crown star facets 24 which have a triangular shape, and are positioned between the table facet 16 and a sets of one crown main 20 and one crown corner 22 facet. The crown additionally includes sixteen crown half facets 26 which have a triangular shape. Each of the sixteen crown half facets 26 is positioned between the girdle portion 10, another crown half facet 26, and a crown main facets 20 or a crown corner facets 22.

Figure 12:
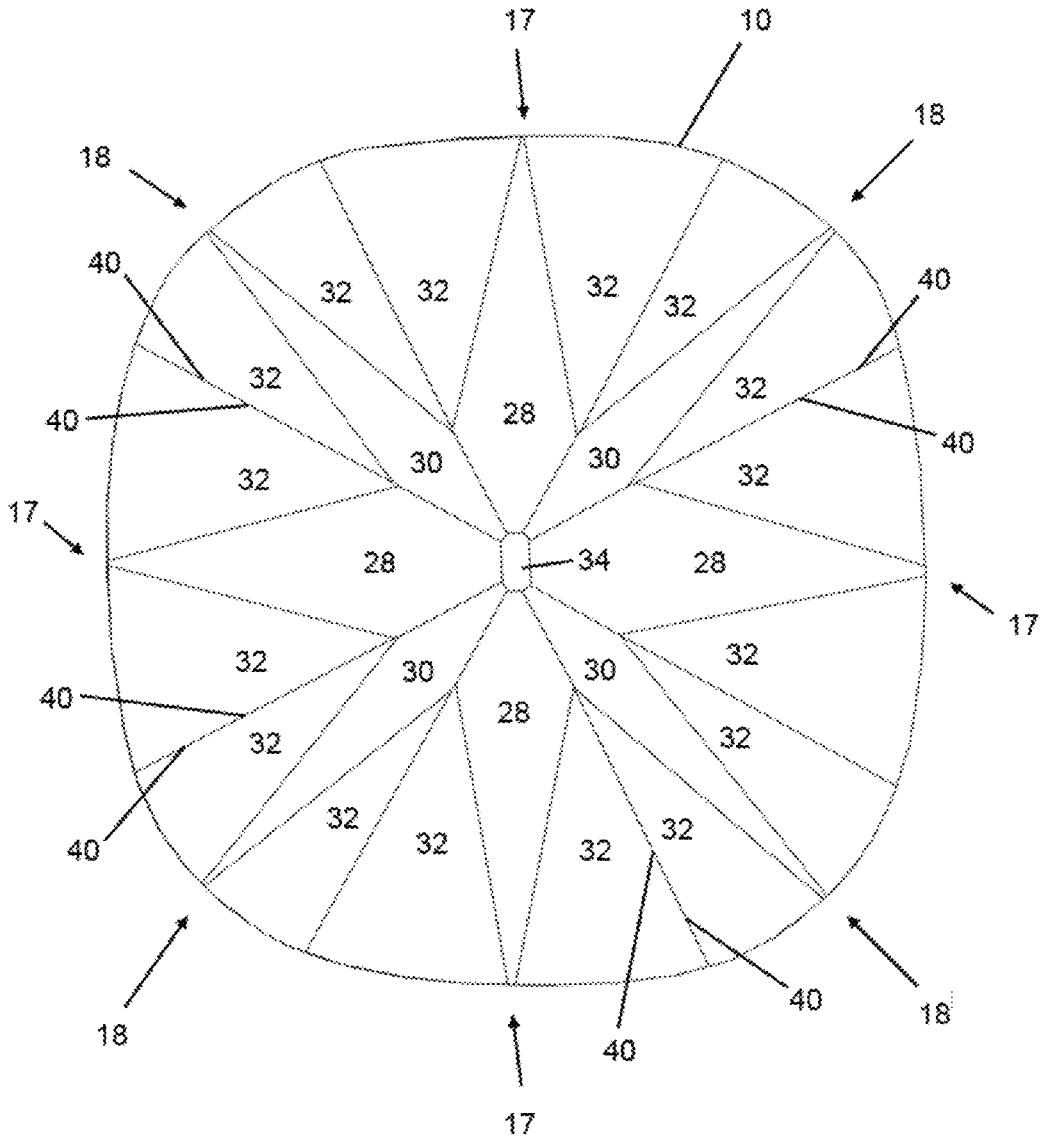

The gemstone of the currently described embodiment further includes a pavilion portion shown in FIG. 12. This pavilion portion is positioned diametrically opposite of the crown portion with the girdle portion 10 being positioned there between, and tapers inward towards a point of convergence 34 as it extends away from the girdle portion 10. It includes four pavilion main facets 28 and four pavilion corner facets 30. Each of the four pavilion main facets 28 is positioned between one of the sides 17 of the girdle portion and the point of convergence 34 such that it substantially extends between about the midpoint of the respective side 17 and about the point of convergence 34. Each of the four pavilion corner facets 30 is positioned between the one of the corners 18 of the girdle portion and the point of convergence 34 such that it substantially extends between about the midpoint of the respective corner 18 and about the point of convergence 34. Both the pavilion main facets 28 and pavilion corner facets 30 are illustrated as having a substantially kite shape. The pavilion main 28 and corner 30 facets are arranged in an alternating fashion such that no two pavilion main facets 28 are immediately adjacent to one another and no two pavilion corner facets 30 are immediately adjacent to one another.

The pavilion portion further includes sixteen pavilion half facets 32 each of which forms a triangular shape and is positioned between the girdle portion 10, another pavilion half facet 32, and a pavilion main facets 28 or a pavilion corner facets 30.

Each of the pavilion half facets 32 includes a side 40 that extends from the girdle portion 10 substantially towards the point of convergence 34 (for the sake of clarity, not all sides 40 are denoted in the figures). In an embodiment, the length of each side (also commonly referred to within the relevant art as pavilion half facet lengths) is from about 60% to about 69% of the total length from the girdle portion 10 to the point of convergence 34. In another embodiment, the length of each side (pavilion half facet lengths) is less than or equal to about 85% of the total length from the girdle portion 10 to the point of convergence 34. Those of ordinary skill in the relevant art are familiar with the concept of pavilion half facet lengths and are aware that the lengths referenced above and measured along the girdle plane. In other words, the end-points of the respective lengths are projected onto the girdle plane and the measurements are taken thereafter.

In another embodiment, the pavilion half face lengths 40 are long enough to extend under the table facet 16 when the gemstone is viewed from above. The extension of the pavilion half facet lengths (and consequently some portions of the pavilion half facets) under the table facet has an effect on the production of a particular optical pattern under the table facet when the gemstone is viewed from above. For example, when the pavilion half facets do not extend under the table facet, the user (when looking through the table facet) observes the presence of the four pavilion main and the four pavilion corner facets all joined at the point of convergence. The four pavilion main facets generally produce an appearance of a Maltese cross having its arms extend vertically and horizontally (relative to the orientation of FIGS. 11-13C). Each of those arms includes two straight sides which extend from the point of convergence to the edge of the table facet. On the other hand, when portions of the pavilion half facets extend under the table facet, the user (when looking through the table facet) then observes not only the four pavilion main and four pavilion corner facets, but also those portions of the pavilion half facets which protrude under the boundaries of the table facet. The presence of the pavilion half facets has the effect of clipping the corners of the arms of the Maltese cross which are opposite of the point of convergence. In other words, now the four pavilion main facets produce a cross in which each arm-side extending from the point of convergence to the edge of the table facet includes two subsections which form some non-180 degree angle at their point of joinder. For the purposes of this specification, such a cross may be referred to as a "modified Maltese cross."

Figure 13A:
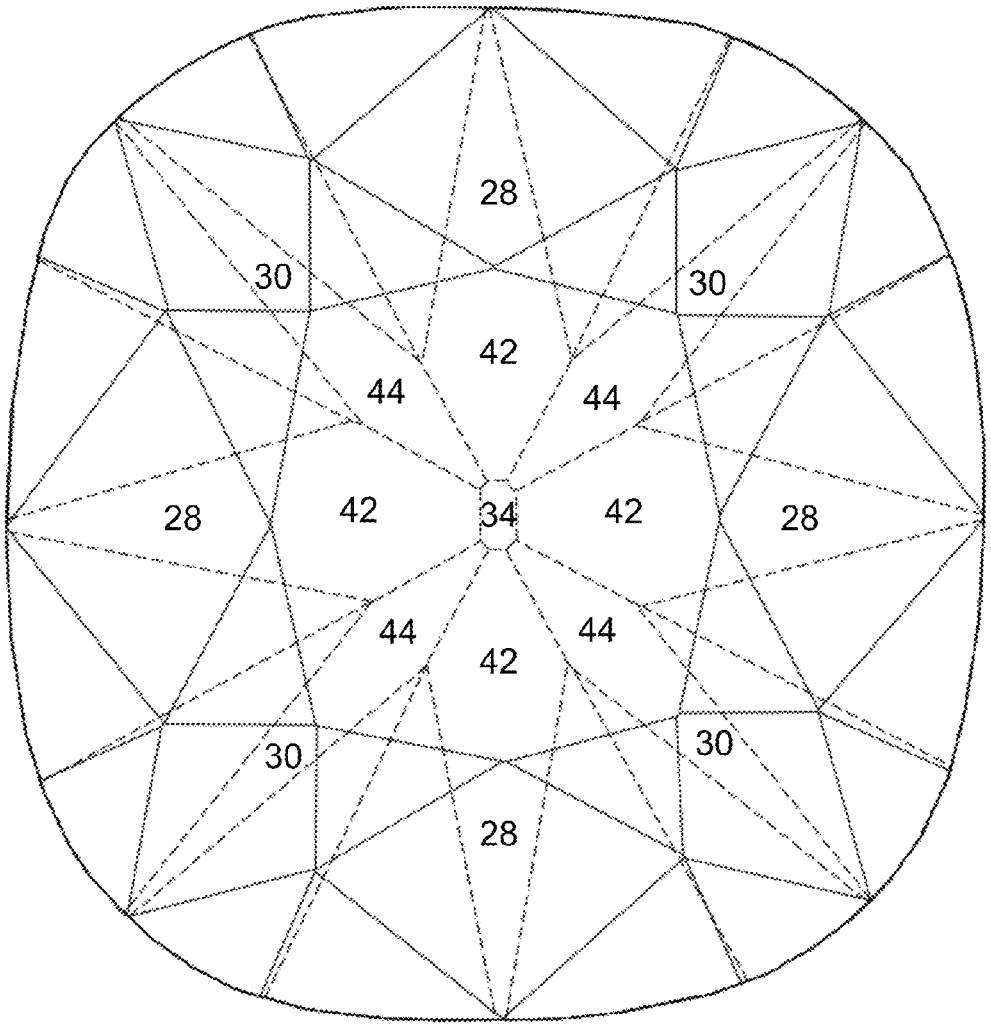
FIG. 13A is a top view of the embodiment of FIGS. 11 and 12 with the outlines of the crown and pavilion facets being shown.
Figure 13B:
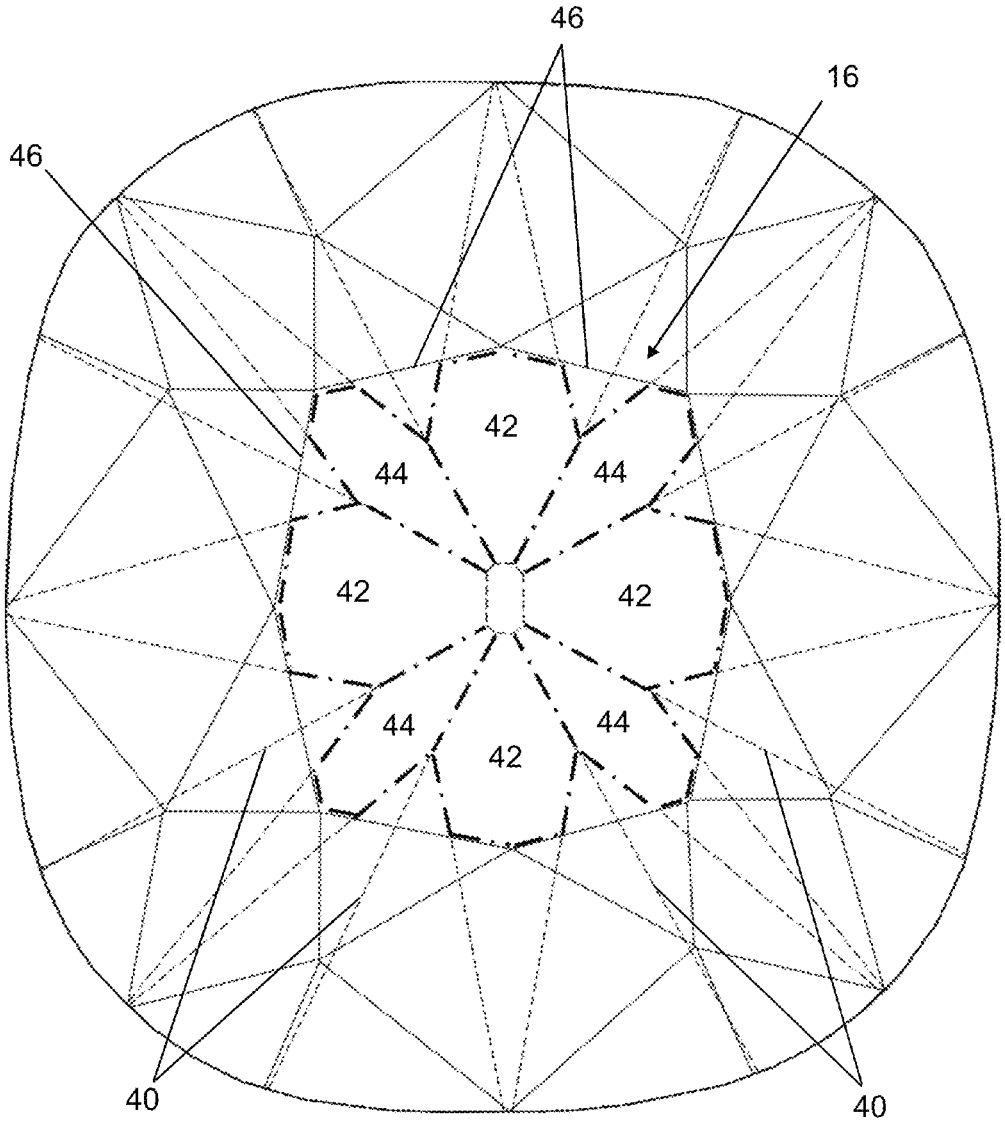
FIGS. 13B and 13C are top views of the embodiment of FIGS. 11 and 12 illustrating an exemplary optical pattern.
Figure 13C:
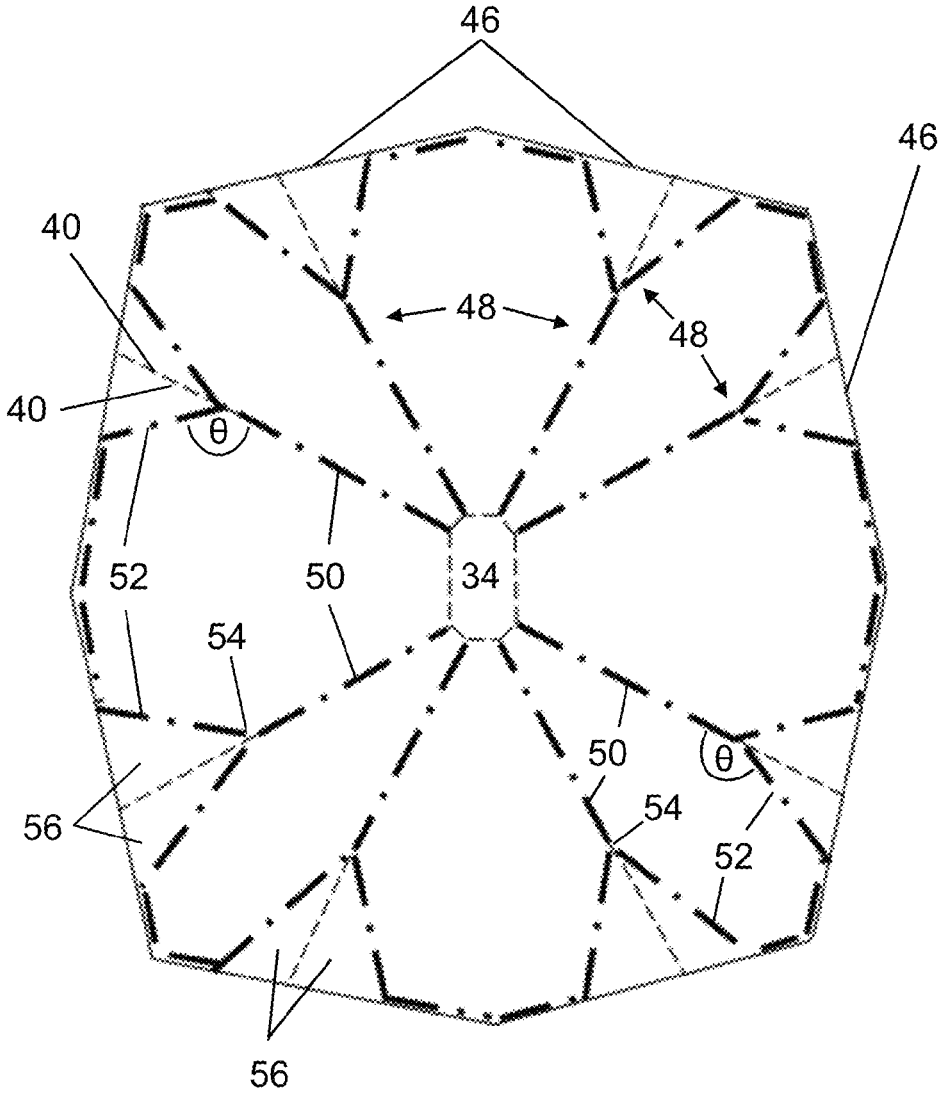

An example of a presence of a modified Maltese cross underneath the table facet is illustrated in FIGS. 13A, 13B, and 13C. FIG. 13A illustrates a top-down view of a gemstone with the outlines of the crown facets being shown in solid lines and the outlines of the pavilion facets being shown in dashed lines, FIG. 13B illustrates the same top-down view the modified Maltese cross outlines being shown in dot-dash lines, and FIG. 13C illustrates a detailed view of the pavilion facet shown in FIG. 13B. As shown in the figures, the arrangement of the four pavilion main facets 28 and the four pavilion corner facets 30 produce two crosses. The first cross is produced by the four pavilion main facets 28 and includes four arms 42. The second cross is produced by the four pavilion corner facets 30 and includes four arms 44. Both crosses' arms 42 and 44 extend outwardly from the point of convergence 34 towards the boundaries 46 of the table facet 16. Each arm 42,44 includes two arm sides 48 which extend between the point of convergence 34 and one of the table facet sides 46. Each arm side 48 includes a first subsection 50 and a second subsection 52, where the first subsection 50 is adjacent to about the point of convergence 34. These two subsections 50,52 are joined together at a joinder point 54, with non-180 degree angle θ being formed between the two subsections. The presence of the joinder point 54 and the arm sides 48 being comprised of two subsections 50,52 is the result of the pavilion half facet lengths 40 extending underneath the table facet 16. Consequently, the far corners 56 of the cross arms 42,44 are clipped by the portions of the pavilion half facets 32 which extend under the table facet 16. Note that for the sake of clarity, not every single element is labeled in the figures. For example, while only two joinder points 54 are illustrated in FIG. 13C, it is understood that such a joinder point is present between all first and second subsections 50,52.

In an embodiment, the ratio of the lengths of the first subsection 50 to the second subsection 52 is greater than or equal to about 2:1. In another embodiment, the ratio of the length of the first subsection 50 to the second subsection 52 is greater than or equal to about 1:1. In still another embodiment, the ratio of the length of the first subsection 50 to the second subsection 52 is greater than or equal to about 3:1. In still yet another embodiment, the maximum width of the table facet 16 is less than or equal to about 60% of the maximum width of the girdle portion 10. In still yet another embodiment, the maximum width of the table facet 16 is between about 48% and about 55% of the maximum width of the girdle portion 10.

The design of FIGS. 11 and 12 can be executed on a variety of gemstones including a diamond. Since different gemstones exhibit different refractive indices, obtaining a particularly desired level of optical performance requires at least some of the gemstone's facets to be positioned at certain predetermined angles chosen specifically for the gemstone's refractive index. When executing the design of FIGS. 11 and 12 on a diamond, a particular range of angular arrangements for the design's facets has been found to produce a particular level of optical performance. In one embodiment, these angular measurements are as follows (note that these angles are expressed with respect to the girdle plane):

crown main facets 20: 38-42.5 degrees;
crown corner facets 22: 37-42.6 degrees;
crown star facets 24: 28-36.5 degrees;
crown half facets 26: 44.8-53.1 degrees;
pavilion main facets 28: 39.3-41.9 degrees, (preferably 40.4-40.9 degrees);
pavilion corner facets 30: 35.5-40 degrees; and
pavilion half facets 32: 37-46.5 degrees.

In another embodiment, these angular measurements are as follows:

average angle of the four crown main facets 20: 38-42.5 degrees;
average angle of the four crown corner facets 22: 37-42.6 degrees;
average angle of the eight crown star facets 24: 28-36.5 degrees;
average angle of the sixteen crown half facets 26: 44.8-53.1 degrees;
average angle of the four pavilion main facets 28: 39.3-41.9 degrees, (preferably 40.4-40.9 degrees);
average angle of the four pavilion corner facets 30: 35.5-40 degrees; and
average angle of the sixteen pavilion half facets 32: 37-46.5 degrees.

In an embodiment, a diamond cut in accordance with the present invention and having a modified Maltese cross under the table facet may exhibit optical performance such that a majority of the cut diamond reflects incident light impinging on the cut diamond at an angle between 45 and 75 degrees with respect to the girdle plane, when the cut diamond is viewed from above.

In an embodiment, a diamond cut in accordance with the present invention and having a modified Maltese cross under the table facet may exhibit optical performance such that at least 65% of the diamond's surface area, when viewed from above, reflects incident light impinging on the cut diamond at an angle between 45 and 75 degrees with respect to the girdle plane.

In an embodiment, a diamond cut in accordance with the present invention and having a modified Maltese cross under the table facet may exhibit optical performance such that the majority of the portions of the pavilion main facets which produce the appearance of the modified Maltese cross reflect incident light impinging on the cut diamond at an angle between 45 and 75 degrees with respect to the girdle plane, when the cut diamond is viewed from above.

In an embodiment, a diamond cut in accordance with the present invention and having a modified Maltese cross under the table facet may exhibit optical performance such that the majority of the portions of the pavilion main facets which produce the appearance of a first modified Maltese cross and the majority of the portions of the pavilion corner facets which produce the appearance of a second modified Maltese cross reflect incident light impinging on the cut diamond at an angle between 45 and 75 degrees with respect to the girdle plane, when the cut diamond is viewed from above.

In an embodiment, a diamond cut in accordance with the present invention and having a modified Maltese cross under the table facet may exhibit optical performance such that its "Light Performance" grade is "Ideal" or "Ideal 0," as determined by the American Gem Society's® Performance Grading Software®.

Figure 14:
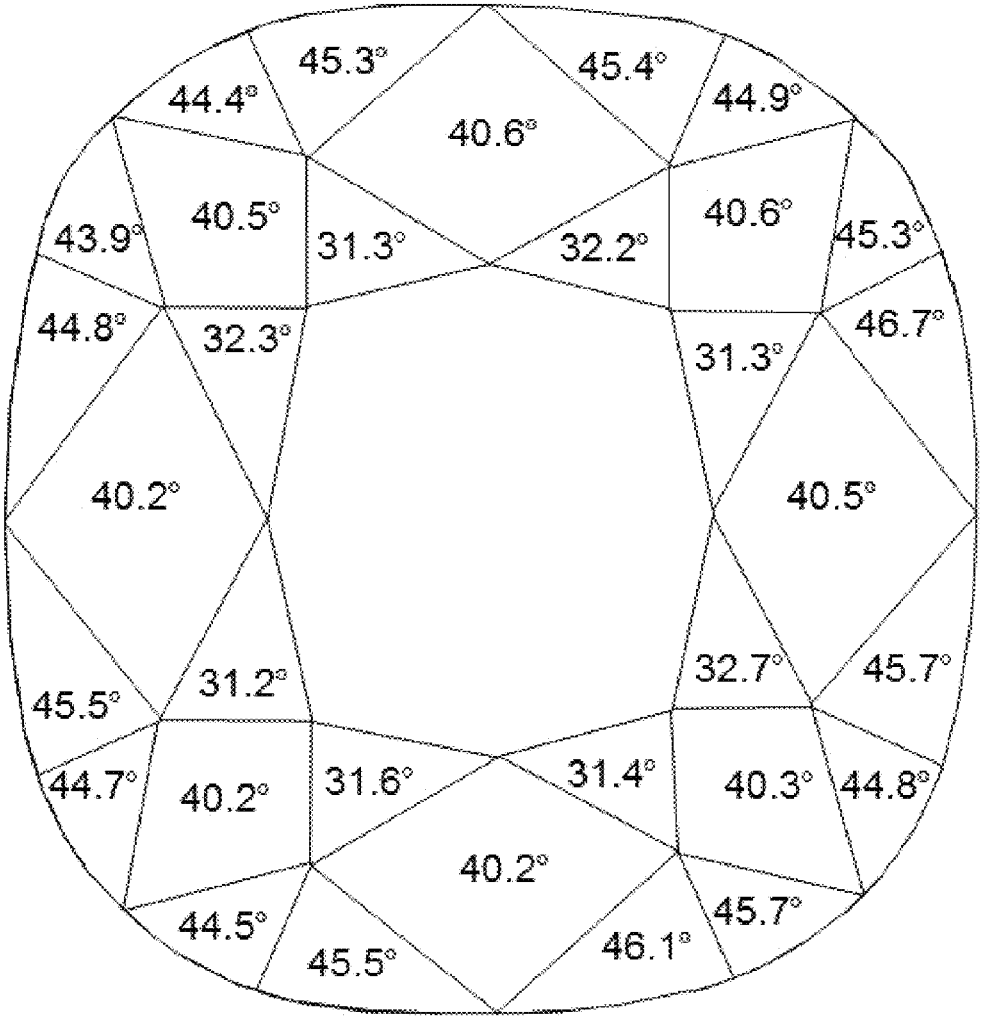
FIGS. 14 and 15 are top and bottom views respectively of still another embodiment of the present invention.
Figure 15:
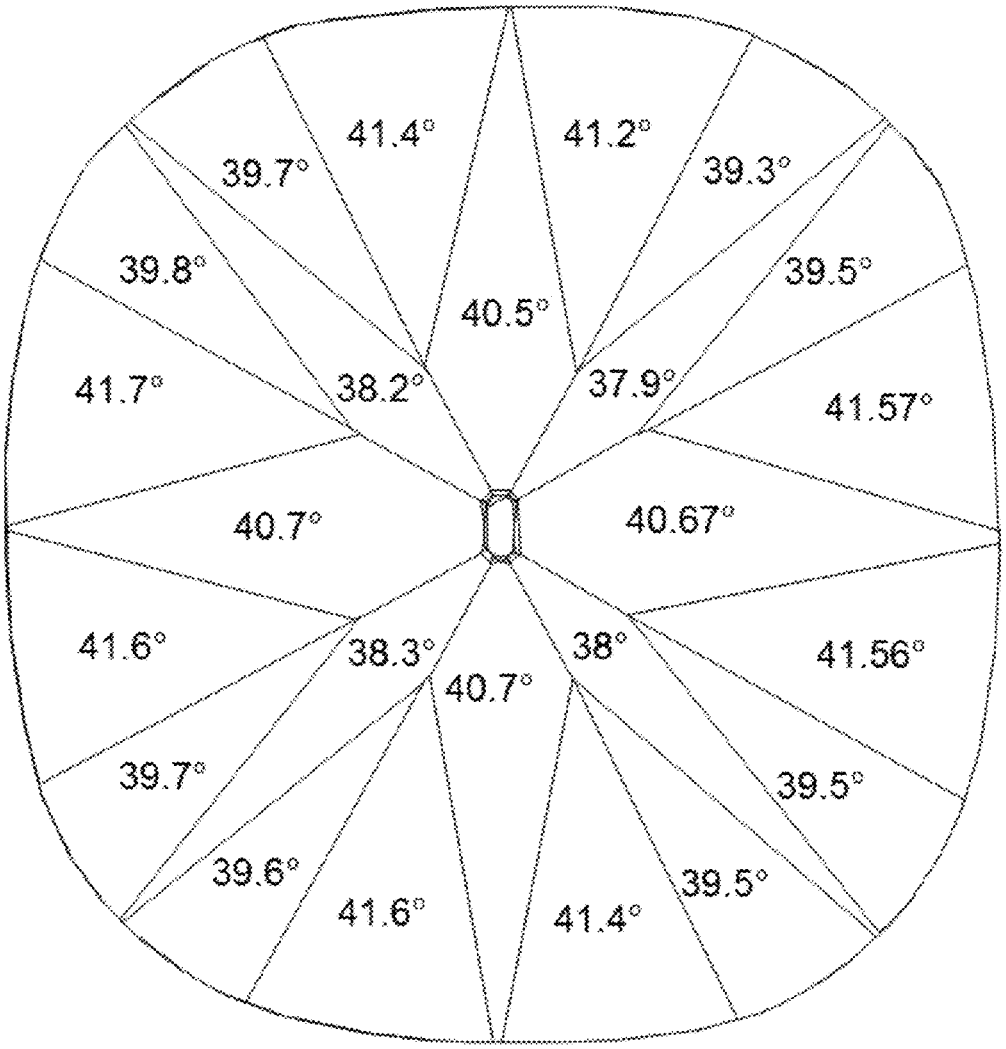
Figure 16:
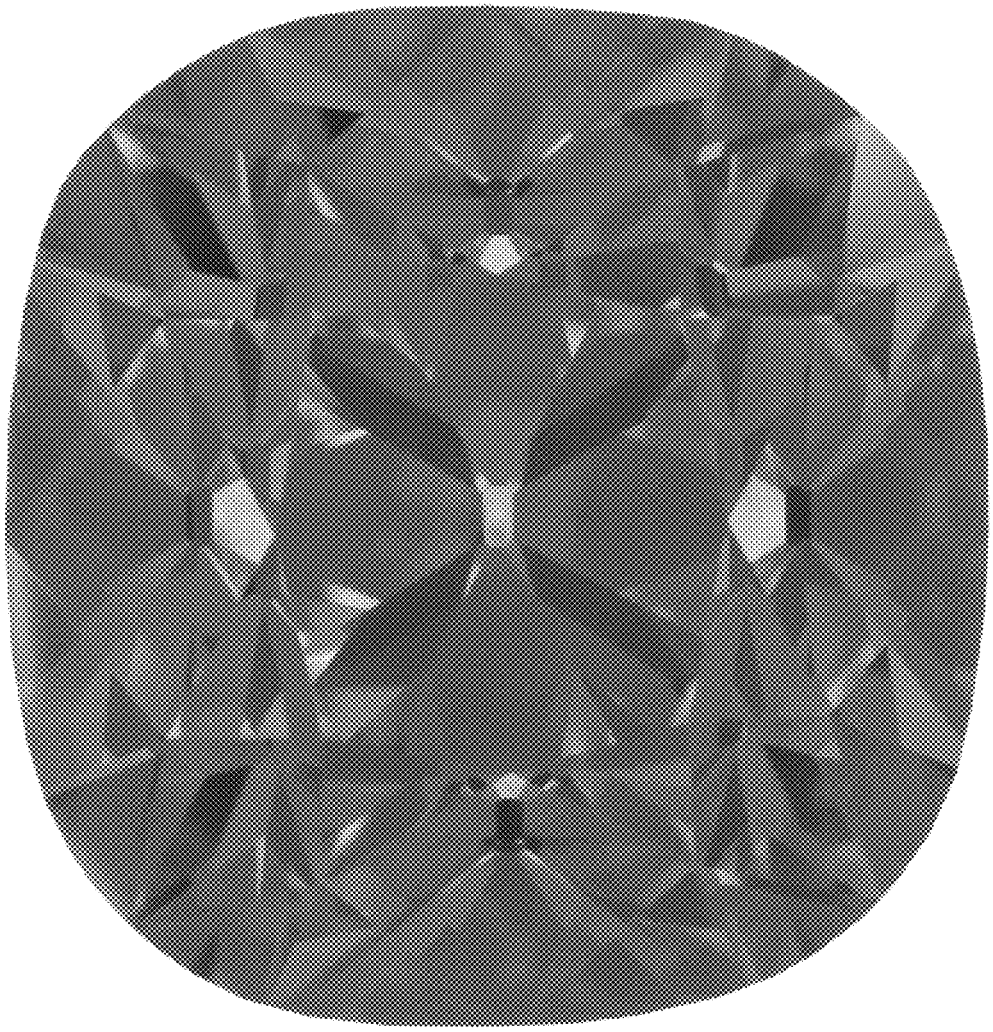
FIG. 16 is an Angular Spectrum Evaluation Tool result of the embodiment of FIGS. 14 and 15.

FIGS. 14 and 15 show a top and a bottom view, respectively, of a diamond cut in accordance with an embodiment of the present invention and having a modified Maltese cross under the table facet. Each of these FIGS denotes the angle of the respective facet with respect to the girdle portion. The angles shown can vary by approximately plus or minus one degree. A corresponding Angular Spectrum Evaluation Tool result for this example is shown in FIG. 16. Those of ordinary skill will be familiar with the use of the Angular Spectrum Evaluation Tool to quantify the results of a gemstone's optical performance and the evaluation of such results. Accordingly, those skilled in the art will recognize that a majority of the cut diamond represented in FIG. 16 reflects incident light impinging on the diamond at an angle between 45 and 75 degrees with respect to the girdle plane, when the diamond is viewed from above. Furthermore, those skilled in the art will recognize that the majority of the portions of the pavilion main facets which produce the appearance of the modified Maltese cross reflect incident light impinging on the diamond at an angle between 45 and 75 degrees with respect to the girdle plane, when the diamond is viewed from above. In addition, the cut diamond represented in FIG. 16 may achieve a grade of "Ideal 0" on the American Gem Society's® Light Performance scale.

Figure 17:
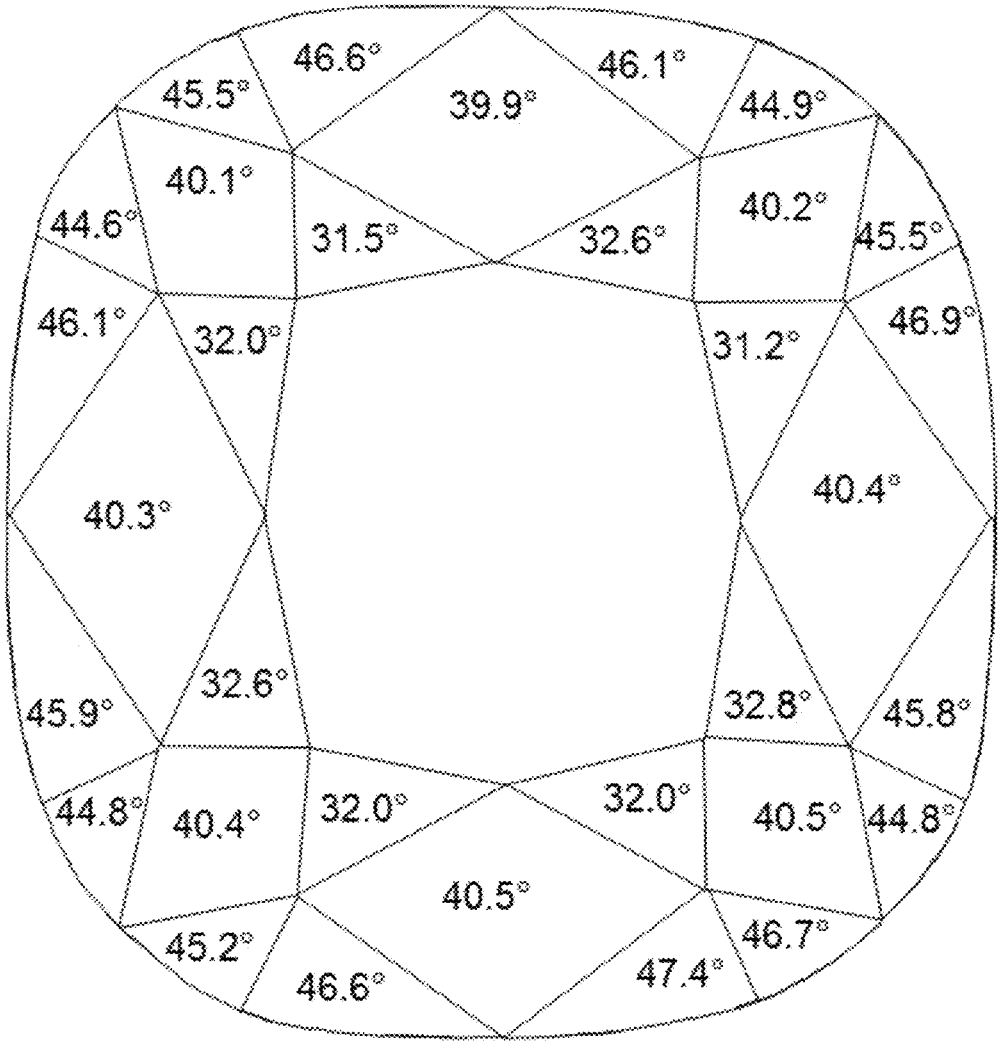
FIGS. 17 and 18 are top and bottom views respectively of still another embodiment of the present invention.
Figure 18:
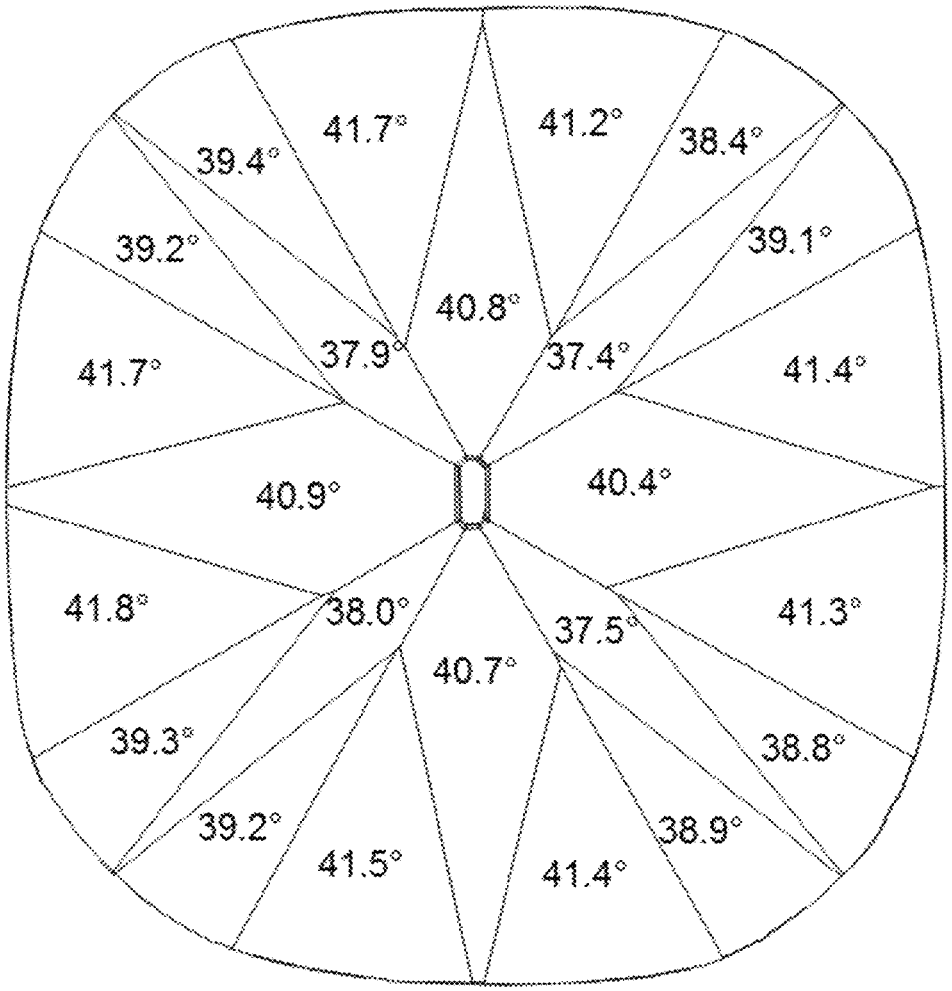
Figure 19:
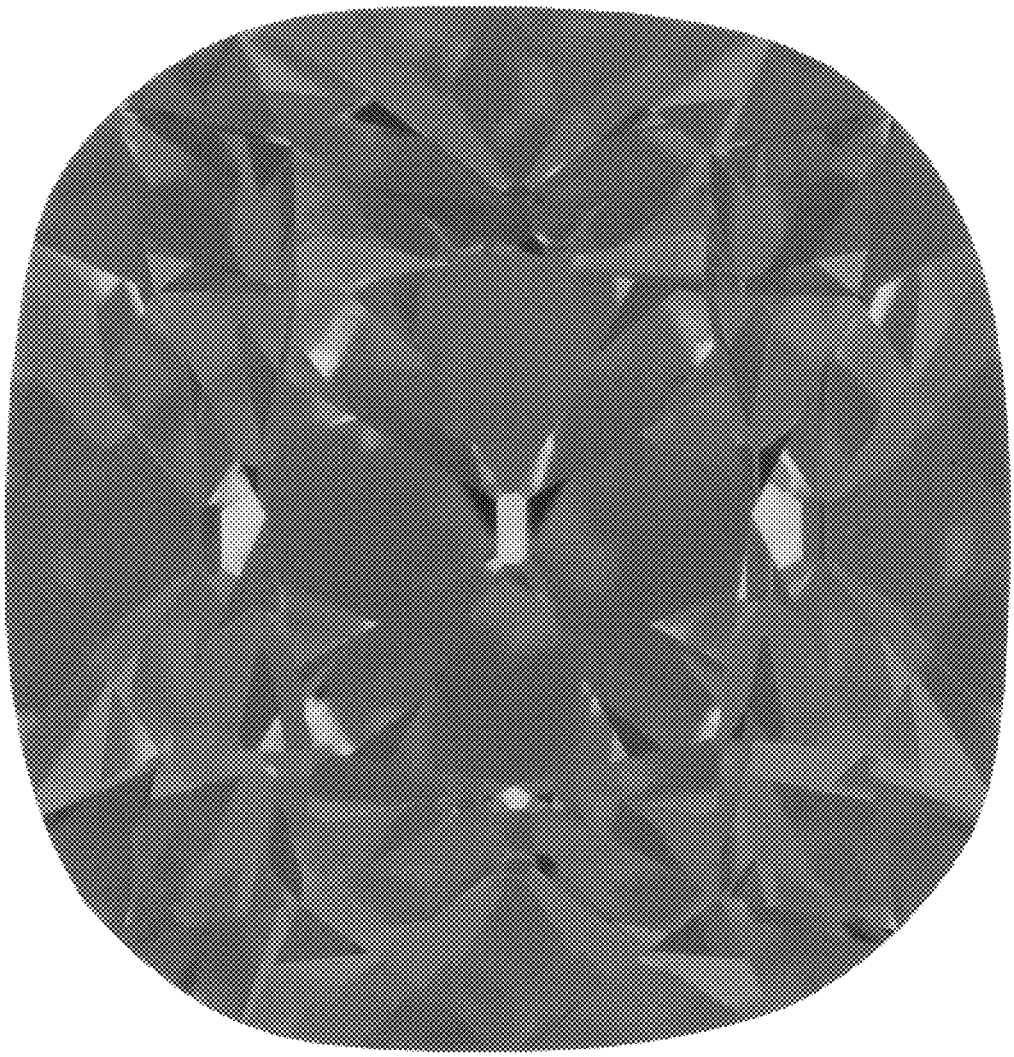
FIG. 19 is an Angular Spectrum Evaluation Tool result of the embodiment of FIGS. 17 and 18.

FIGS. 17 and 18 show a top and a bottom view, respectively, of a diamond cut in accordance with an embodiment of the present invention and having a modified Maltese cross under the table facet. Each of these FIGS denotes the angle of the respective facet with respect to the girdle portion. A corresponding Angular Spectrum Evaluation Tool result for this example is shown in FIG. 19. From this result, those skilled in the art will recognize that a majority of the cut diamond represented in FIG. 19 reflects incident light impinging on the diamond at an angle between 45 and 75 degrees with respect to the girdle plane, when the diamond is viewed from above. Furthermore, those skilled in the art will recognize that the majority of the portions of the pavilion main facets which produce the appearance of the modified Maltese cross reflect incident light impinging on the diamond at an angle between 45 and 75 degrees with respect to the girdle plane, when the diamond is viewed from above. In addition, the cut diamond represented in FIG. 19 may achieve a grade of "Ideal 0" on the American Gem Society's® Light Performance scale.

The cut gemstones of the present invention are not limited to only the above described facets. Additional facets can be included, especially to complete an enclosed volume. Furthermore, it should be understood that references to a majority include an entirety.

Note that while this invention has been described in terms of several embodiments, these embodiments are non-limiting (regardless of whether they have been labeled as exemplary or not), and there are alterations, permutations, and equivalents, which fall within the scope of this invention. In addition, the various embodiments of the present invention should not be considered as mutually exclusive. Furthermore, it should be understood that any optical performance results shown herein are not intended to be limiting of the present invention. Instead, these results are to be understood as exemplary, illustrating the generalized representation of the optical performance of the present invention according to only some of the embodiments. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

I claim:

1. A cut diamond having a plurality of facets, said cut diamond comprising:

a girdle portion having four sides and four corners, said girdle portion having a girdle plane;

a crown portion adjacent to said girdle portion, said crown portion including:

a table facet having eight sides and eight vertices;

four crown main facets, each of said four crown main facets positioned between said table facet and one of said four sides of said girdle portion, and extends between about one of said eight vertices of said table facet and about a midpoint of respective said one side, each of said four crown main facets being arranged at an angle between 38 and 42.5 degrees with respect to said girdle plane;

four crown corner facets, each of said four crown corner facets positioned between said table facet and one of said four corners of said girdle portion, and extends between about one of said eight vertices of said table facet and about a midpoint of respective said one corner, each of said four crown corner facets further positioned between two of said four crown main facets, each of said four crown corner facets being arranged at an angle between 37 and 42.6 degrees with respect to said girdle plane;

eight crown star facets, each of said eight crown star facets positioned between said table facet, one of said four crown main facets, and one of said four crown corner facets, each of said eight crown star facets being arranged at an angle between 28 and 36.5 degrees with respect to said girdle plane; and sixteen crown half facets, each of said sixteen crown half facets positioned between said girdle portion, one other said crown half facet, and one of one of said four crown main facets and one of said four crown corner facets, each of said sixteen crown half facets being arranged at an angle between 44.8 and 53.1 degrees with respect to said girdle plane; and a pavilion portion adjacent to said girdle portion and positioned diametrically opposite said crown portion, said pavilion portion tapering inward towards a point of convergence as it extends away from said girdle portion, said pavilion portion including:

four pavilion main facets, each of said four pavilion main facets positioned partially below one of said four crown main facets when said cut diamond is viewed from above, each of said four pavilion main facets further positioned between one of said four sides of said girdle portion and said point of convergence, and extends between about said midpoint of respective said one side and about said point of convergence, each of said four pavilion main facets being arranged at an angle between 39.3 and 41.9 degrees with respect to said girdle plane;

four pavilion corner facets, each of said four pavilion corner facets positioned partially below one of said four crown corner facets when said cut diamond is viewed from above, each of said four pavilion corner facets further positioned between one of said four corners of said girdle portion and said point of convergence, and extends between about said midpoint of respective said one corner and about said point of convergence, each of said four pavilion corner facets being arranged at an angle between 35.5 and 40 degrees with respect to said girdle plane; and sixteen pavilion half facets, each of said sixteen pavilion half facets positioned between said girdle portion, one other said pavilion half facet, and one of one of said four pavilion main facets and one of said four pavilion corner facets, each of said sixteen pavilion half facets being arranged at an angle between 37 and 46.5 degrees with respect to said girdle plane, each of said sixteen pavilion half facets including a respective side extending from a respective girdle/pavilion point on said girdle portion towards said point of convergence with a respective pavilion half facet length that is less than or equal to about 85% of a respective total pavilion length from said respective girdle/pavilion point to said point of convergence, each of said respective pavilion half facet lengths and each of said respective total pavilion lengths measured along said girdle plane;

wherein, when said cut diamond is viewed from above, a majority of said cut diamond reflects incident light impinging on said cut diamond at an angle between 45 and 75 degrees with respect to said girdle plane.

2. The cut diamond of claim 1, wherein said majority of said cut diamond comprises at least 65% of said diamond's surface area, when said cut diamond is viewed from above.

3. The cut diamond of claim 1, wherein said four pavilion main facets produce an optical pattern of a first cross under said table facet when said cut diamond is viewed from above, said first cross including four arms extending from said point of convergence towards said sides of girdle portion, each of said four arms including two arm sides extending from said point of convergence to one of said eight sides of said table facet, each of said arm sides including a first subsection and a second subsection, said first and said second subsections being joined at a joinder point and forming a non-180 degree angle there between.

4. The cut diamond of claim 3, wherein a majority of portions of said pavilion main facets which produce said optical pattern of said cross reflect incident light impinging on said cut diamond at an angle between 45 and 75 degrees with respect to said girdle plane, when said cut diamond is viewed from above.

5. The cut diamond of claim 4, wherein said four pavilion corner facets produce an optical pattern of a second cross under said table facet when said cut diamond is viewed from above, said second cross including four second arms extending from said point of convergence towards said corners of girdle portion, each of said four second arms including two second arm sides extending from said point of convergence to one of said eight sides of said table facet, each of said second arm sides including a third subsection and a fourth subsection, said third and said fourth subsections being joined at a second joinder point and forming a non-180 degree angle there between.

6. The cut diamond of claim 5, wherein a majority of portions of said pavilion corner facets which produce said optical pattern of said second cross reflect incident light impinging on said cut diamond at an angle between 45 and 75 degrees or at an angle between 75 and 90 degrees with respect to said girdle plane, when said cut diamond is viewed from above.

7. The cut diamond of claim 3, wherein said first subsection is adjacent to said point of convergence, and wherein a ratio of a length of said first subsection to a length of said second subsection is greater than or equal to about 1:1.

8. The cut diamond of claim 1, wherein an amount of said reflected incident light which impinges on said cut diamond at an angle between 45 and 75 degrees with respect to said girdle plane is sufficient for said cut diamond to be graded Ideal 0 on an AGS Light Performance scale.

9. The cut diamond of claim 1, wherein each of said sixteen crown half facets includes a respective side extending from a respective girdle/crown point on said girdle portion towards said table facet with a respective crown half facet length that is 40% to 60% of a respective total crown length from said respective girdle/crown point to said table facet, each of said respective crown half facet lengths and each of said respective total crown lengths measured along said girdle plane.

10. The cut diamond of claim 1, wherein said point of convergence includes a culet.

11. The cut diamond of claim 1, wherein each of said four corners of said girdle portion is a rounded corner.

12. The cut diamond of claim 1, wherein: each of said four crown main facets has a substantially kite shape, each of said four crown corner facets has a substantially kite shape, each of said eight crown star facets has a triangular shape, each of said sixteen crown half facets has a triangular shape, each of said four pavilion main facets has a has a substantially kite shape, each of said four pavilion corner facets has a has a substantially kite shape, and each of said sixteen pavilion half facets has a triangular shape.

13. The cut diamond of claim 1, wherein said girdle portion includes a maximum girdle width and wherein said table facet includes a maximum table width that is less than 60% of said maximum girdle width.

14. A cut diamond having a plurality of facets, said cut diamond comprising:

a girdle portion having four sides and four corners, said girdle portion having a girdle plane;

a crown portion adjacent to said girdle portion, said crown portion including:

a table facet having eight sides and eight vertices;

four crown main facets, each of said four crown main facets positioned between said table facet and one of said four sides of said girdle portion, and extends between about one of said eight vertices of said table facet and about a midpoint of respective said one side, each of said four crown main facets being arranged at an angle between 38 and 42.5 degrees with respect to said girdle plane;

four crown corner facets, each of said four crown corner facets positioned between said table facet and one of said four corners of said girdle portion, and extends between about one of said eight vertices of said table facet and about a midpoint of respective said one corner, each of said four crown corner facets further positioned between two of said four crown main facets, each of said four crown corner facets being arranged at an angle between 37 and 42.6 degrees with respect to said girdle plane;

eight crown star facets, each of said eight crown star facets positioned between said table facet, one of said four crown main facets, and one of said four crown corner facets, each of said eight crown star facets being arranged at an angle between 28 and 36.5 degrees with respect to said girdle plane; and sixteen crown half facets, each of said sixteen crown half facets positioned between said girdle portion, one other said crown half facet, and one of one of said four crown main facets and one of said four crown corner facets, each of said sixteen crown half facets being arranged at an angle between 44.8 and 53.1 degrees with respect to said girdle plane; and a pavilion portion adjacent to said girdle portion and positioned diametrically opposite said crown portion, said pavilion portion tapering inward towards a point of convergence as it extends away from said girdle portion, said pavilion portion including:

four pavilion main facets, each of said four pavilion main facets positioned partially below one of said four crown main facets when said cut diamond is viewed from above, each of said four pavilion main facets further positioned between one of said four sides of said girdle portion and said point of convergence, and extends between about said midpoint of respective said one side and about said point of convergence, each of said four pavilion main facets being arranged at an angle between 39.3 and 41.9 degrees with respect to said girdle plane;

four pavilion corner facets, each of said four pavilion corner facets positioned partially below one of said four crown corner facets when said cut diamond is viewed from above, each of said four pavilion corner facets further positioned between one of said four corners of said girdle portion and said point of convergence, and extends between about said midpoint of respective said one corner and about said point of convergence, each of said four pavilion corner facets being arranged at an angle between 35.5 and 40 degrees with respect to said girdle plane; and sixteen pavilion half facets, each of said sixteen pavilion half facets positioned between said girdle portion, one other said pavilion half facet, and one of one of said four pavilion main facets and one of said four pavilion corner facets, each of said sixteen pavilion half facets being arranged at an angle between 37 and 46.5 degrees with respect to said girdle plane;

wherein said four pavilion main facets produce an optical pattern of a first cross under said table facet when said cut diamond is viewed from above, said first cross including four arms extending from said point of convergence towards said sides of girdle portion, each of said four arms including two arm sides extending from said point of convergence to one of said eight sides of said table facet, each of said arm sides including a first subsection and a second subsection, said first and said second subsections being joined at a joinder point and forming a non-180 degree angle there between, and wherein, when said cut diamond is viewed from above, a majority of said cut diamond reflects incident light impinging on said cut diamond at an angle between 45 and 75 degrees with respect to said girdle plane.

15. The cut diamond of claim 14, wherein a majority of portions of said pavilion main facets which produce said optical pattern of said cross reflect incident light impinging on said cut diamond at an angle between 45 and 75 degrees with respect to said girdle plane, when said cut diamond is viewed from above.

16. The cut diamond of claim 15, wherein said four pavilion corner facets produce an optical pattern of a second cross under said table facet when said cut diamond is viewed from above, said second cross including four second arms extending from said point of convergence towards said corners of girdle portion, each of said four second arms including two second arm sides extending from said point of convergence to one of said eight sides of said table facet, each of said second arm sides including a third subsection and a fourth subsection, said third and said fourth subsections being joined at a second joinder point and forming a non-180 degree angle there between.

17. The cut diamond of claim 16, wherein a majority of portions of said pavilion corner facets which produce said optical pattern of said second cross reflect incident light impinging on said cut diamond at an angle between 45 and 75 degrees or at an angle between 75 and 90 degrees with respect to said girdle plane, when said cut diamond is viewed from above.

18. The cut diamond of claim 14, wherein said first subsection is adjacent to said point of convergence, and wherein a ratio of a length of said first subsection to a length of said second subsection is greater than or equal to about 1:1.

19. The cut diamond of claim 14, wherein said majority of said cut diamond comprises at least 65% of said diamond's surface area, when said cut diamond is viewed from above.

20. The cut diamond of claim 14, wherein an amount of said reflected incident light which impinges on said cut diamond at an angle between 45 and 75 degrees with respect to said girdle plane is sufficient for said cut diamond to be graded Ideal 0 on an AGS Light Performance scale.

21. The cut diamond of claim 14, wherein each of said sixteen crown half facets includes a respective side extending from a respective girdle/crown point on said girdle portion towards said table facet with a respective crown half facet length that is 40% to 60% of a respective total crown length from said respective girdle/crown point to said table facet, each of said respective crown half facet lengths and each of said respective total crown lengths measured along said girdle plane.

22. The cut diamond of claim 14, wherein said point of convergence includes a culet.

23. The cut diamond of claim 14, wherein each of said four corners of said girdle portion is a rounded corner.

24. The cut diamond of claim 14, wherein: each of said four crown main facets has a substantially kite shape, each of said four crown corner facets has a substantially kite shape, each of said eight crown star facets has a triangular shape, each of said sixteen crown half facets has a triangular shape, each of said four pavilion main facets has a has a substantially kite shape, each of said four pavilion corner facets has a has a substantially kite shape, and each of said sixteen pavilion half facets has a triangular shape.

25. The cut diamond of claim 14, wherein said girdle portion includes a maximum girdle width and wherein said table facet includes a maximum table width that is less than 60% of said maximum girdle width.

26. A cut diamond having a plurality of facets, said cut diamond comprising:

a girdle portion having four sides and four corners, said girdle portion having a girdle plane;

a crown portion adjacent to said girdle portion, said crown portion including:

a table facet having eight sides and eight vertices;

four crown main facets, each of said four crown main facets positioned between said table facet and one of said four sides of said girdle portion, and extends between about one of said eight vertices of said table facet and about a midpoint of respective said one side, each of said four crown main facets being arranged at an angle between 38 and 42.5 degrees with respect to said girdle plane;

four crown corner facets, each of said four crown corner facets positioned between said table facet and one of said four corners of said girdle portion, and extends between about one of said eight vertices of said table facet and about a midpoint of respective said one corner, each of said four crown corner facets further positioned between two of said four crown main facets, each of said four crown corner facets being arranged at an angle between 37 and 42.6 degrees with respect to said girdle plane;

eight crown star facets, each of said eight crown star facets positioned between said table facet, one of said four crown main facets, and one of said four crown corner facets, each of said eight crown star facets being arranged at an angle between 28 and 36.5 degrees with respect to said girdle plane; and sixteen crown half facets, each of said sixteen crown half facets positioned between said girdle portion, one other said crown half facet, and one of one of said four crown main facets and one of said four crown corner facets, each of said sixteen crown half facets being arranged at an angle between 44.8 and 53.1 degrees with respect to said girdle plane; and a pavilion portion adjacent to said girdle portion and positioned diametrically opposite said crown portion, said pavilion portion tapering inward towards a point of convergence as it extends away from said girdle portion, said pavilion portion including:

four pavilion main facets, each of said four pavilion main facets positioned partially below one of said four crown main facets when said cut diamond is viewed from above, each of said four pavilion main facets further positioned between one of said four sides of said girdle portion and said point of convergence, and extends between about said midpoint of respective said one side and about said point of convergence, each of said four pavilion main facets being arranged at an angle between 39.3 and 41.9 degrees with respect to said girdle plane;

four pavilion corner facets, each of said four pavilion corner facets positioned partially below one of said four crown corner facets when said cut diamond is viewed from above, each of said four pavilion corner facets further positioned between one of said four corners of said girdle portion and said point of convergence, and extends between about said midpoint of respective said one corner and about said point of convergence, each of said four pavilion corner facets being arranged at an angle between 35.5 and 40 degrees with respect to said girdle plane; and sixteen pavilion half facets, each of said sixteen pavilion half facets positioned between said girdle portion, one other said pavilion half facet, and one of one of said four pavilion main facets and one of said four pavilion corner facets, each of said sixteen pavilion half facets being arranged at an angle between 37 and 46.5 degrees with respect to said girdle plane;

wherein said four pavilion main facets produce an optical pattern of a first cross under said table facet when said cut diamond is viewed from above, said first cross including four arms extending from said point of convergence towards said sides of girdle portion, each of said four arms including two arm sides extending from said point of convergence to one of said eight sides of said table facet, each of said arm sides including a first subsection and a second subsection, said first and said second subsections being joined at a joinder point and forming a non-180 degree angle there between, and wherein a majority of portions of said pavilion main facets which produce said optical pattern of said cross reflect incident light impinging on said cut diamond at an angle between 45 and 75 degrees with respect to said girdle plane, when said cut diamond is viewed from above.

27. The cut diamond of claim 26, wherein said four pavilion corner facets produce an optical pattern of a second cross under said table facet when said cut diamond is viewed from above, said second cross including four second arms extending from said point of convergence towards said corners of girdle portion, each of said four second arms including two second arm sides extending from said point of convergence to one of said eight sides of said table facet, each of said second arm sides including a third subsection and a fourth subsection, said third and said fourth subsections being joined at a second joinder point and forming a non-180 degree angle there between.

28. The cut diamond of claim 27, wherein a majority of portions of said pavilion corner facets which produce said optical pattern of said second cross reflect incident light impinging on said cut diamond at an angle between 45 and 75 degrees or at an angle between 75 and 90 degrees with respect to said girdle plane, when said cut diamond is viewed from above.

29. The cut diamond of claim 26, wherein, when said cut diamond is viewed from above, a majority of said cut diamond reflects incident light impinging on said cut diamond at an angle between 45 and 75 degrees with respect to said girdle plane, said majority comprising at least 65% of said diamond's surface area, when said cut diamond is viewed from above.

30. The cut diamond of claim 29, wherein an amount of said reflected incident light which impinges on said cut diamond at an angle between 45 and 75 degrees with respect to said girdle plane is sufficient for said cut diamond to be graded Ideal 0 on an AGS Light Performance scale.

31. The cut diamond of claim 26, wherein each of said sixteen crown half facets includes a respective side extending from a respective girdle/crown point on said girdle portion towards said table facet with a respective crown half facet length that is 40% to 60% of a respective total crown length from said respective girdle/crown point to said table facet, each of said respective crown half facet lengths and each of said respective total crown lengths measured along said girdle plane.

32. The cut diamond of claim 26, wherein each of said four corners of said girdle portion is a rounded corner.

33. The cut diamond of claim 26, wherein: each of said four crown main facets has a substantially kite shape, each of said four crown corner facets has a substantially kite shape, each of said eight crown star facets has a triangular shape, each of said sixteen crown half facets has a triangular shape, each of said four pavilion main facets has a has a substantially kite shape, each of said four pavilion corner facets has a has a substantially kite shape, and each of said sixteen pavilion half facets has a triangular shape.

34. The cut diamond of claim 26, wherein said girdle portion includes a maximum girdle width and wherein said table facet includes a maximum table width that is less than 60% of said maximum girdle width.

* * * * *